US010604998B2

(12) United States Patent
Greene et al.

(10) Patent No.: US 10,604,998 B2
(45) Date of Patent: Mar. 31, 2020

(54) SHADING DISPLAY AND SAMPLE

(71) Applicant: Hunter Douglas Inc., Pearl River, NY (US)

(72) Inventors: Katherine E. Greene, Golden, CO (US); Steffen Koury, Everett, MA (US); Mary Lonergan, Arvada, CO (US); Paul K. Metaxatos, Swampscott, MA (US); David B. McNeill, Denver, CO (US); Stephen T. Wisecup, Niwot, CO (US); Ronald Holt, Westminster, CO (US); Michael Kritzer, Seattle, WA (US)

(73) Assignee: Hunter Douglas Inc., Pearl River, NY (US)

( * ) Notice: Subject to any disclaimer, the term of this patent is extended or adjusted under 35 U.S.C. 154(b) by 491 days.

(21) Appl. No.: 15/019,119

(22) Filed: Feb. 9, 2016

(65) Prior Publication Data

US 2016/0237741 A1 Aug. 18, 2016

Related U.S. Application Data

(60) Provisional application No. 62/115,839, filed on Feb. 13, 2015.

(51) Int. Cl.
*E06B 9/00* (2006.01)
*G09F 5/00* (2006.01)
(Continued)

(52) U.S. Cl.
CPC ..... *E06B 9/322* (2013.01); *E06B 9/24* (2013.01); *E06B 9/262* (2013.01); *E06B 9/32* (2013.01);
(Continued)

(58) Field of Classification Search
CPC ..... G09F 2005/047; G09F 5/02; E06B 2009/2429; E06B 9/262; E06B 2009/2622;
(Continued)

(56) References Cited

U.S. PATENT DOCUMENTS 73,213 A * 1/1868 Wharry ..... E06B 9/52 160/91
817,209 A 4/1906 Williams
(Continued)

FOREIGN PATENT DOCUMENTS

CA 2622936 A1 8/2009
CN ZL201530185731.3 6/2016
(Continued)

OTHER PUBLICATIONS

Hunter Douglas Collection Book, published Sep. 2013, 3 pages.

*Primary Examiner* — Daniel P Cahn

(57) ABSTRACT

A shading display and sample may include a frame structure, a drive assembly operably connected to the frame structure, and a shade material associated with the drive assembly for corresponding movement thereof. Operation of the drive assembly may move the shade material between open and closed positions. The display may permit users to position and operate a covering sample near an architectural opening to assess the overall operation, appearance, translucence, texture, or other qualities of the covering based on the angular orientation and material of the sample.

18 Claims, 28 Drawing Sheets

(51) Int. Cl.

| | |
|---|---|
| ***E06B 9/322*** | (2006.01) |
| ***E06B 9/262*** | (2006.01) |
| ***E06B 9/24*** | (2006.01) |
| ***E06B 9/32*** | (2006.01) |
| ***G09F 5/02*** | (2006.01) |
| *A47F 7/00* | (2006.01) |

(52) U.S. Cl.
CPC ..... *G09F 5/00* (2013.01); *G09F 5/02* (2013.01); *A47F 7/0042* (2013.01); *E06B 2009/2429* (2013.01); *E06B 2009/2447* (2013.01)

(58) Field of Classification Search
CPC ..... E06B 2009/2458; E06B 2009/2447; E06B 2009/2423; E06B 2009/2435
USPC ..... 160/351, 84.06, 84.01, 182, 239, 240
See application file for complete search history.

(56) References Cited

U.S. PATENT DOCUMENTS 1,238,703 A * 8/1917 Wendelken ..... E06B 9/52 160/103
2,311,300 A * 2/1943 Dubour ..... E06B 7/084 160/104
2,359,289 A * 10/1944 Brown ..... E06B 7/084 160/104
2,388,646 A * 11/1945 Ryan ..... G09F 11/025 40/505
2,631,339 A * 3/1953 Pratt ..... E06B 9/264 160/107
2,707,839 A 5/1955 Green
2,748,499 A * 6/1956 Shafer ..... G09F 5/02 434/74
2,795,059 A 6/1957 Mendelsohn
2,824,394 A 2/1958 Lohnes
2,935,165 A * 5/1960 Elliott ..... G09F 5/02 190/16
3,008,248 A 11/1961 Steinthal
3,514,875 A 6/1970 Howard
3,596,814 A * 8/1971 Kelley ..... A47F 7/16 223/28
3,631,975 A 1/1972 Leibowitz
3,714,725 A 2/1973 Banks
3,776,503 A 12/1973 Boden et al.
4,307,768 A * 12/1981 Anderson ..... E06B 9/262 160/5
4,365,355 A 12/1982 Off et al.
4,433,883 A * 2/1984 Boender ..... G09F 5/00 211/191
4,456,122 A 6/1984 Kalal
4,458,435 A 7/1984 Ackerman
D284,435 S 7/1986 Zelenko et al.
4,636,037 A 1/1987 Thomke et al.
4,721,638 A 1/1988 Matsuguchi et al.
4,756,693 A 7/1988 Matsuno
4,848,855 A 7/1989 Cone
4,945,969 A * 8/1990 Schnebly ..... D06H 3/08 160/273.1
4,974,658 A * 12/1990 Komatsu ..... E06B 9/13 160/133
5,000,242 A * 3/1991 Coddens ..... E06B 9/264 160/107
5,007,473 A * 4/1991 Evensen ..... A47F 5/105 160/135
5,031,781 A 7/1991 Price et al.
5,050,747 A 9/1991 Krautsack
5,184,659 A * 2/1993 Alcocer ..... B60J 1/2091 160/84.04
5,231,809 A * 8/1993 Benjamino ..... B60P 3/32 135/117
5,282,504 A * 2/1994 Anderson ..... E06B 9/01 160/107
5,311,356 A * 5/1994 Freilich ..... G02B 27/2228 351/159.02
5,323,836 A * 6/1994 Tuttle ..... G09F 15/0068 160/135
5,368,485 A * 11/1994 Phillips ..... G09B 5/02 434/75
5,370,024 A 12/1994 Lerner et al.
5,584,329 A * 12/1996 Thomas ..... E06B 9/262 160/134
5,647,485 A 7/1997 Verrangia
D384,229 S 9/1997 Verrangia
5,662,153 A * 9/1997 Rosenblatt ..... E06B 9/262 160/134
5,688,125 A 11/1997 Birdsong-Raffo
D390,871 S 2/1998 Whitney
5,720,396 A 2/1998 Wegscheid et al.
D391,989 S 3/1998 Plutsky
5,782,051 A * 7/1998 LaVoie ..... F24F 13/08 454/277
5,787,951 A * 8/1998 Tonomura ..... E06B 9/262 160/84.01
5,794,680 A * 8/1998 Xue ..... E06B 9/262 160/134
5,888,117 A 3/1999 Sutton
6,006,812 A * 12/1999 Corey ..... E06B 9/262 160/176.1 R
6,019,864 A 2/2000 Jones
6,029,733 A * 2/2000 Xue ..... E06B 9/262 160/134
6,065,523 A * 5/2000 Sanz ..... B64C 1/1484 160/84.02
6,068,139 A 5/2000 Brozak, Jr.
6,119,756 A * 9/2000 Tatro ..... E06B 9/264 160/107
6,204,896 B1 3/2001 Matsuhira et al.
6,257,301 B1 * 7/2001 Conforti ..... E06B 9/26 160/84.01
6,310,612 B1 10/2001 Kotsubo et al.
6,328,090 B1 * 12/2001 Anderson ..... E06B 7/30 160/107
6,354,353 B1 * 3/2002 Green ..... E06B 9/26 160/84.04
6,478,071 B1 * 11/2002 Workman ..... E06B 9/32 160/169
6,503,188 B1 * 1/2003 August ..... A47C 21/00 160/238
6,571,851 B1 * 6/2003 Jelic ..... E06B 9/262 160/107
6,591,887 B1 * 7/2003 Hsu ..... E06B 9/262 160/84.03
6,665,965 B1 12/2003 Turchi et al.
6,691,872 B1 2/2004 Berman et al.
6,740,379 B1 5/2004 Congard et al.
7,097,049 B1 8/2006 Singer et al.
7,111,659 B2 * 9/2006 Harper ..... A47H 2/00 160/291
7,168,475 B2 * 1/2007 Colson ..... E06B 7/086 160/168.1 R
7,201,205 B2 * 4/2007 Lyness ..... E06B 9/264 160/107
7,210,587 B1 5/2007 Singer et al.
7,290,365 B1 11/2007 Plutsky
7,353,856 B2 * 4/2008 Pon ..... E06B 9/34 160/120
7,549,455 B2 * 6/2009 Harper ..... E06B 9/264 160/121.1
7,628,195 B2 * 12/2009 Drew ..... E06B 7/086 160/176.1 R
7,637,301 B2 * 12/2009 Forst Randle ..... E06B 9/40 160/121.1
7,665,617 B2 2/2010 Shea
7,992,330 B2 8/2011 DaRif et al.
8,074,698 B2 * 12/2011 Allsopp ..... E06B 9/264 160/107
8,132,679 B2 3/2012 Berry et al.
8,286,808 B1 10/2012 Setlik

(56) References Cited

U.S. PATENT DOCUMENTS 8,496,039 B1* 7/2013 Barresi ..... E06B 7/09 160/107
8,944,132 B1* 2/2015 Floyd ..... A47G 5/02 160/23.1
9,038,292 B2 5/2015 Lynch
D734,060 S 7/2015 Colson et al.
D734,061 S 7/2015 Colson et al.
9,476,255 B2* 10/2016 Nurre ..... E06B 9/42
2003/0070767 A1* 4/2003 Workman ..... E06B 9/32 160/84.04
2004/0069417 A1* 4/2004 Sun ..... E06B 7/28 160/107
2004/0079492 A1* 4/2004 Lin ..... E06B 9/262 160/84.01
2004/0099626 A1 5/2004 Belt
2004/0154243 A1* 8/2004 Park ..... G09F 11/29 52/204.5
2005/0155722 A1* 7/2005 Colson ..... E06B 9/262 160/89
2005/0170151 A1 8/2005 Dobson et al.
2005/0235530 A1 10/2005 Boisvert
2006/0000559 A1 1/2006 Bohlen
2006/0021712 A1* 2/2006 Hsu ..... A47H 23/01 160/84.01
2006/0042760 A1* 3/2006 Larsen ..... E06B 9/262 160/84.04
2006/0042761 A1* 3/2006 Larsen ..... E06B 9/262 160/84.07
2006/0130980 A1* 6/2006 Gromotka ..... E06B 9/264 160/107
2006/0257609 A1 11/2006 Winter
2007/0074826 A1* 4/2007 Jelic ..... A47H 23/04 160/84.05
2007/0175593 A1* 8/2007 Lin ..... E06B 9/30 160/84.01
2007/0234599 A1 10/2007 David
2008/0092457 A1 4/2008 Malone et al.
2008/0113318 A1 5/2008 Veltri et al.
2008/0149279 A1 6/2008 Leighty et al.
2009/0211715 A1* 8/2009 Udofia ..... A47F 7/0042 160/32
2010/0038042 A1* 2/2010 Criss ..... E06B 9/40 160/313
2010/0288446 A1 11/2010 Foley et al.
2010/0300630 A1 12/2010 Su
2011/0067827 A1* 3/2011 Douglas ..... E06B 9/262 160/369
2011/0094688 A1* 4/2011 Grossman ..... E06B 9/262 160/218
2012/0006498 A1* 1/2012 Potter ..... A01K 1/035 160/127
2012/0018108 A1 1/2012 Lin
2012/0144708 A1 6/2012 Schwartz
2012/0148766 A1 6/2012 Massol
2012/0175070 A1 7/2012 Rupel
2012/0189797 A1 7/2012 Moriba
2012/0285915 A1 11/2012 O'Quinn et al.
2012/0329011 A1 12/2012 Clark
2013/0042511 A1 2/2013 Schwartz
2013/0047478 A1 2/2013 Chang
2013/0228295 A1 9/2013 Chen
2013/0340303 A1 12/2013 Lamendella
2014/0165434 A1 6/2014 Lynch
2014/0168779 A1 6/2014 Malkan
2014/0182793 A1* 7/2014 Byun ..... E06B 9/42 160/84.06
2014/0216666 A1 8/2014 Smith et al.
2014/0250804 A1* 9/2014 Kuperus ..... E06B 9/40 52/173.1
2014/0318720 A1* 10/2014 Watkins ..... E05F 17/00 160/176.1 R
2015/0014260 A1 1/2015 Lynch
2015/0121760 A1* 5/2015 Drohan ..... E06B 7/30 49/86.1
2015/0197984 A1 7/2015 Anderson et al.
2015/0218881 A1 8/2015 Cheringal et al.
2016/0163239 A1 6/2016 Church et al.
2016/0186486 A1 6/2016 Chen
2016/0273268 A1 9/2016 Yocum et al.
2016/0376836 A1* 12/2016 Cheng ..... E06B 9/24 160/89

FOREIGN PATENT DOCUMENTS

GB 2358511 A 7/2001
HK 1501191.1M001 6/2015
HK 1501191.1M002 6/2015
HK 1501191.1M003 6/2015
HK 1501191.1M004 6/2015
JP 1547968 3/2016
JP 1547969 3/2016
JP 1547970 3/2016
JP 1547971 3/2016
KR 30-0852238 4/2016
TW D147064 A 5/2012
WO 2011/026245 A1 3/2011
WO 2014/099871 A2 6/2014

* cited by examiner

SHADING DISPLAY AND SAMPLE

CROSS-REFERENCE TO RELATED APPLICATIONS

This application claims the benefit of priority under 35 U.S.C. § 119(e) of U.S. provisional patent application No. 62/115,839, filed Feb. 13, 2015, and entitled "Display Tool for Sampling a Covering for an Architectural Opening," which is hereby incorporated herein in its entirety.

BACKGROUND

Coverings for architectural openings, such as windows, doors, archways, and the like, have taken numerous forms for many years. Display tools typically are used to help a customer choose between the many forms of coverings, including color and fabric options. Typically, the display tools do not selectively show the covering in either a closed position or an open position or anywhere in between. This is a significant inconvenience to the customer.

FIELD

This present disclosure relates generally to coverings for architectural openings, and more specifically to a shading display and sample.

BRIEF SUMMARY

The present disclosure generally provides a display tool for sampling a covering for an architectural opening that offers improvements or an alternative to existing arrangements. Preferably, the display tool displays a scaled-down sample of a shade for demonstrating the functional (e.g., operation) and/or aesthetic (e.g., general appearance, translucence, texture, etc.) characteristics of the corresponding full-sized shade. The display tool may allow for demonstrating the operation of the full-sized shade without using the actual mechanism, or may allow for demonstrating the operation of the full-sized shade using a scaled-down version of the actual mechanism. In a preferred embodiment, the display tool allows users to quickly and accurately sample the characteristics of the shade in the actual environment in which the full-sized shade will be installed.

Embodiments of the disclosure may include a display tool for sampling a covering for an architectural opening. In some embodiments, the display tool may include a frame structure, a drive assembly operably connected to the frame structure, a plurality of blades rotatably supported by the frame structure and operatively connected to the drive assembly, and a shade material attached to the plurality of blades. Operation of the drive assembly may rotate the plurality of blades to move the plurality of blades between a closed position and an open position.

Embodiments of the disclosure may include a display system for sampling a covering of an architectural opening. In some embodiments, the display system may include a storage container defining a chamber, and a display tool releasably secured within the chamber. The display tool may include a frame structure, a drive assembly operably connected to the frame structure, a plurality of blades rotatably supported by the frame structure and operatively connected to the drive assembly, and a shade material attached to the plurality of blades. Operation of the drive assembly may rotate the plurality of blades to move the plurality of blades between a closed position and an open position.

Embodiments of the disclosure may include a method of assembling a display tool. In some embodiments, the method includes attaching a shade material to a plurality of blades, attaching the plurality of blades to a frame structure, and operably connecting a drive assembly to the frame structure and the plurality of blades to rotationally displace the plurality of blades within an interior opening of the frame structure from a closed position to an open position.

Embodiments of the disclosure may include a method of sampling a covering of an architectural opening using a display tool. The display tool may include a frame structure, a drive assembly operably connected to the frame structure, a plurality of blades rotatably supported by the frame structure and operatively connected to the drive assembly, and a shade material attached to the plurality of blades. In some embodiments, the method includes operating the drive assembly to move the plurality of blades between a closed position and an open position.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The accompanying drawings, which are incorporated into and constitute a part of the specification, illustrate embodiments of the present disclosure by way of illustration only and, together with the general description given above and the detailed description given below, serve to explain the principles of the present disclosure.

DETAILED DESCRIPTION

Figure 1:
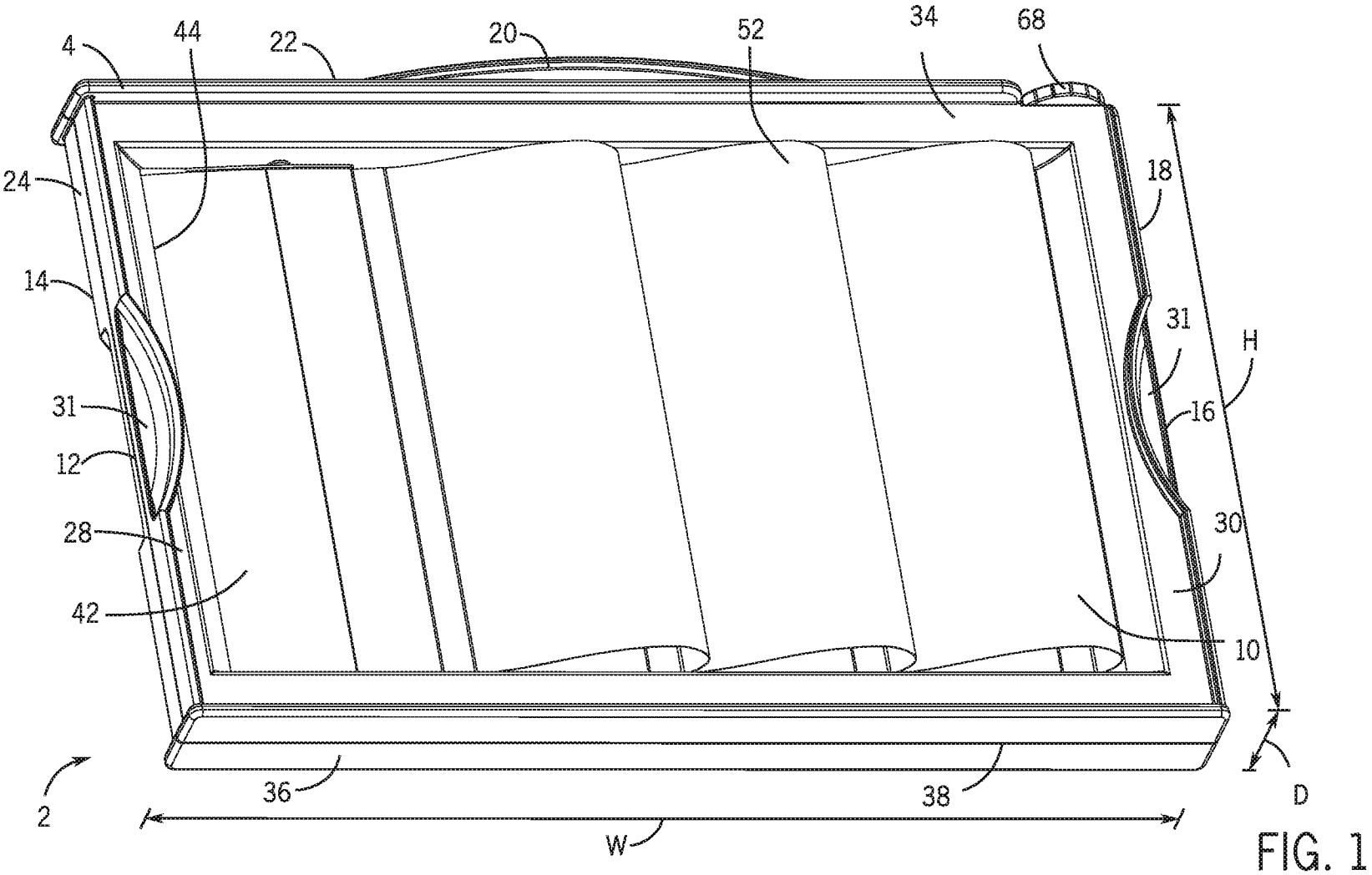
FIG. 1 is a front isometric view of an architectural covering display tool in closed position accordance with an embodiment of the present disclosure.
Figure 2:
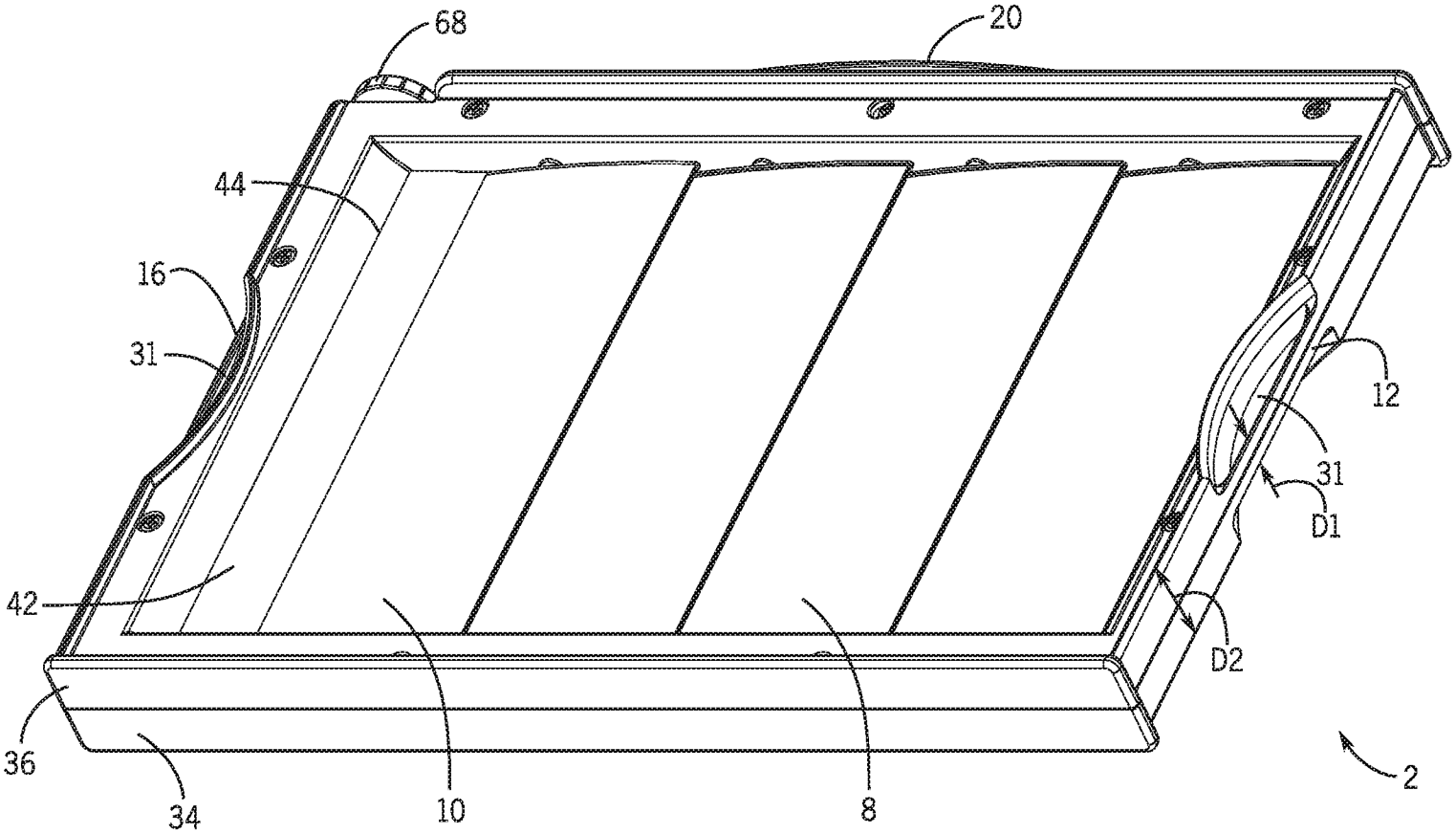
FIG. 2 is a rear isometric view of the display tool of FIG. 1 in accordance with an embodiment of the present disclosure.
Figure 3:
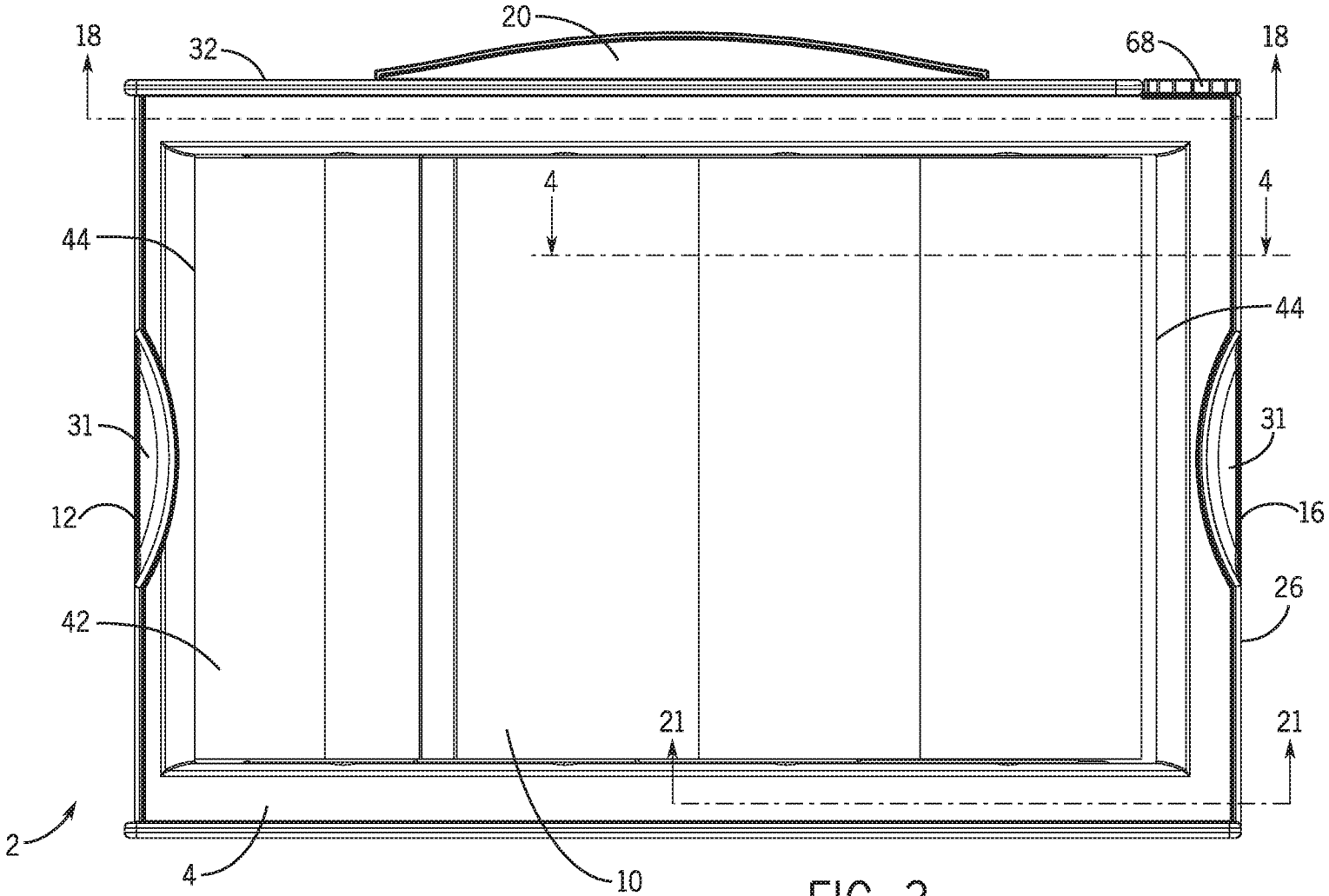
FIG. 3 is a front elevation view of the display tool of FIG. 1 in accordance with an embodiment of the present disclosure.
Figure 4:
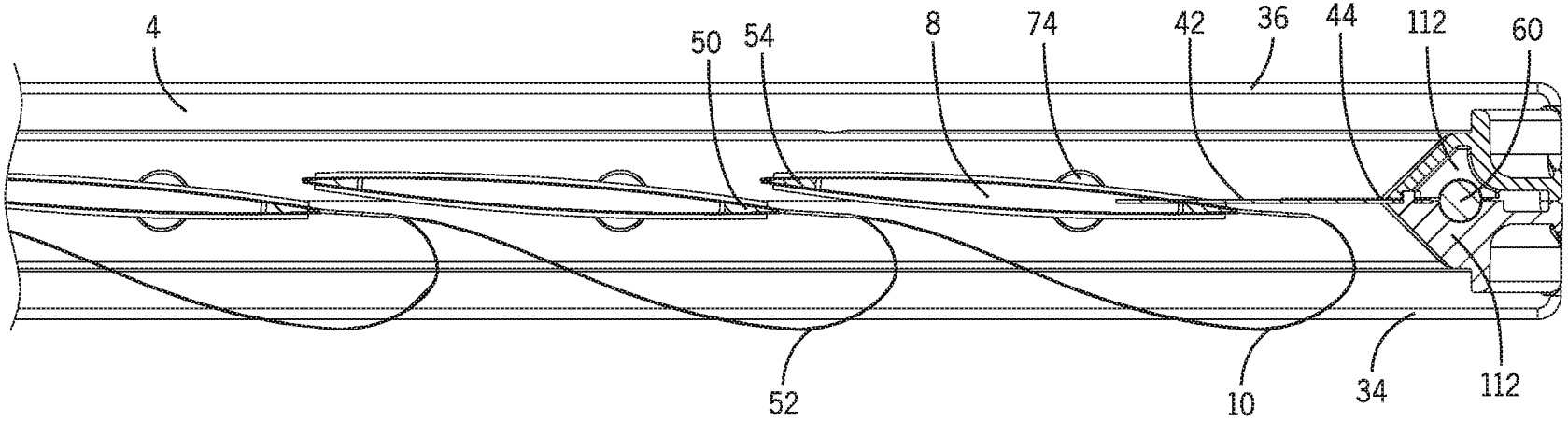
FIG. 4 is a fragmentary cross-sectional view of the display tool of FIG. 1 taken along line 4-4 of FIG. 3 in accordance with an embodiment of the present disclosure.
Figure 5:
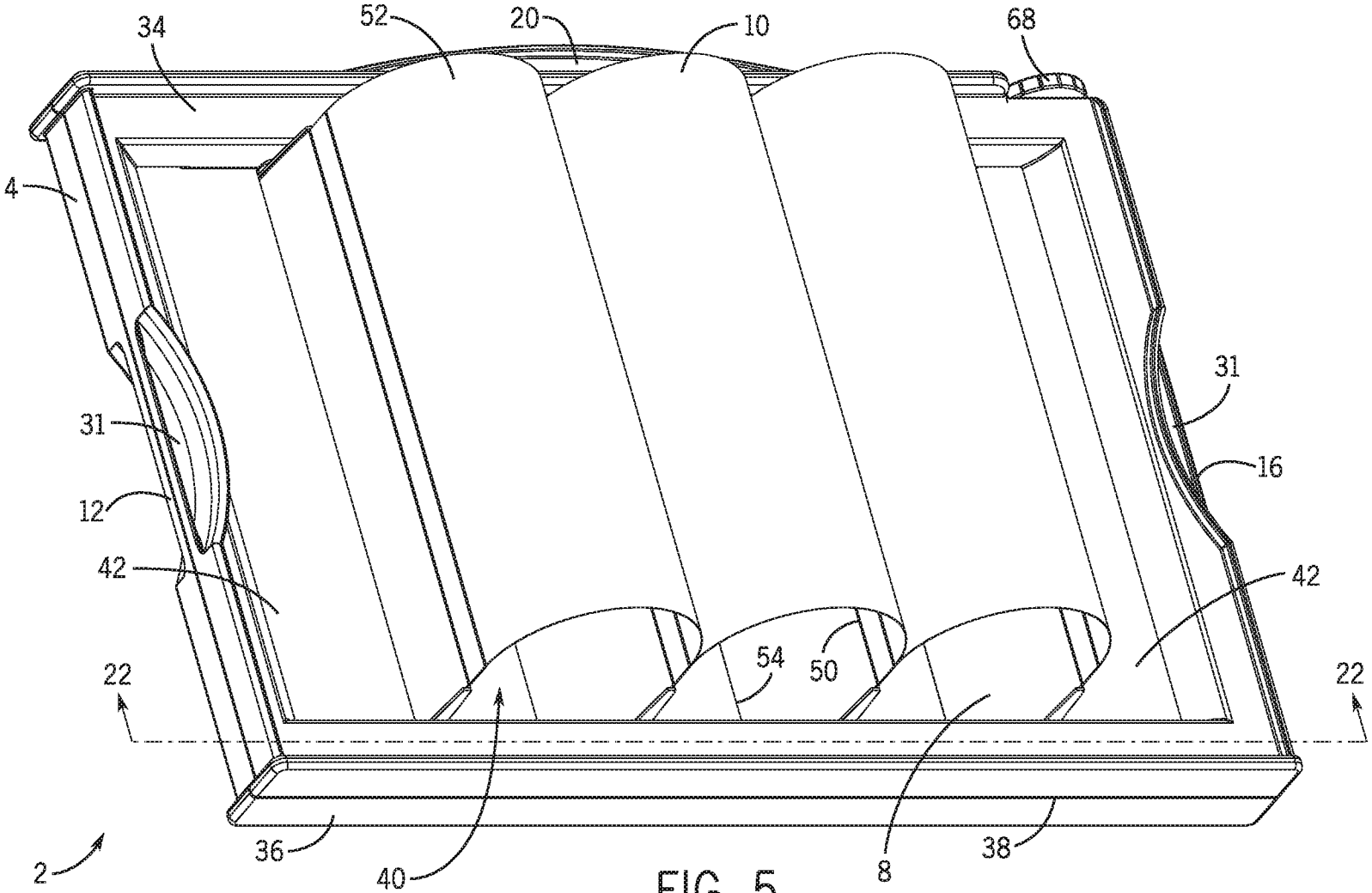
FIG. 5 is a front isometric view of an architectural covering display tool in an open position in accordance with an embodiment of the present disclosure.
Figure 6:
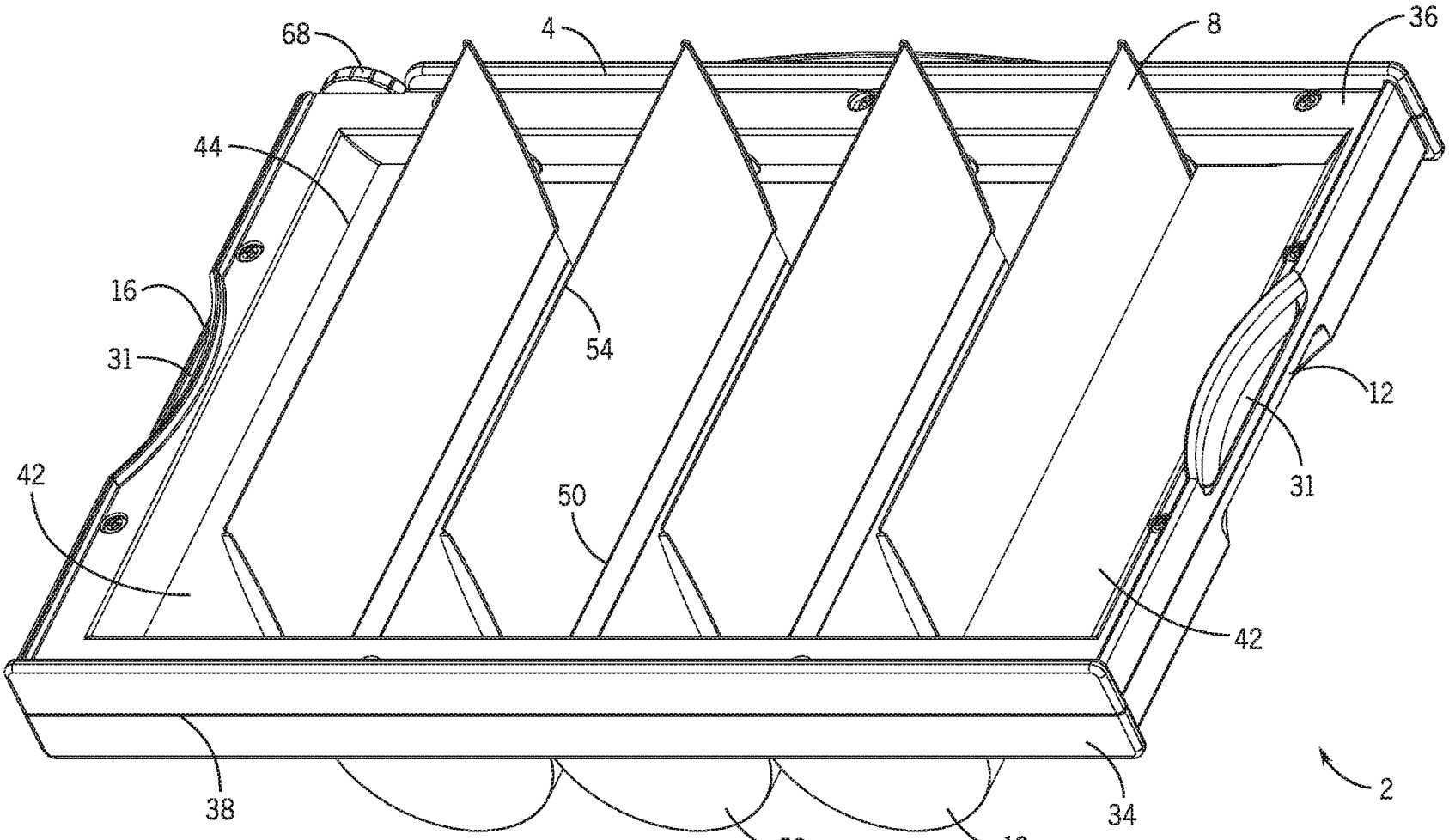
FIG. 6 is a rear isometric view of the display tool of FIG. 5 in accordance with an embodiment of the present disclosure.

The present disclosure generally provides a display tool for sampling a covering for an architectural opening. The display tool enables viewing and operating of covering samples adjacent an architectural opening, such as a window opening, without a dealer or customer permanently installing the covering adjacent the architectural opening. The display tool allows customers to position and operate a covering sample near an architectural opening to assess the overall operation, appearance, translucence, texture, or other qualities of the covering based on the angular orientation and material of the sample. The display tool generally improves the overall experience and allows customers to sample the characteristics of the covering in the customer's own environment.

Referring to FIGS. 1-7B, a display tool 2 for sampling a covering for an architectural opening is provided. The display tool 2 may include a frame structure 4, a drive assembly 6 operably connected to the frame structure 4, a plurality of blades 8 rotatably supported by the frame structure 4 and operatively connected to the drive assembly 6, and a shade material 10 attached to the blades 8. In some embodiments, at least a portion of the drive assembly 6 may be substantially rigid. The frame structure 4 is portable and may be substantially cuboid in shape having a width W and a height H both greater than a depth D. In some embodiments, the frame structure 4 may include dimensions smaller than those of a typical architectural opening such that the display tool 2 may be considered to sample a scaled-down version of an associated covering. For example, both the height H and the width W of the frame structure 4 may be smaller than those of a smallest architectural opening in which the shade material 10 would be placed. The shade material 10 may include the same material (e.g., fabric) as in the corresponding full-sized shade, and the elements of the shade material 10 may operate substantially in the same way. However, the display tool 2 is scaled-down to allow ready transport and display of the shade material 10. As such, the display tool 2 may be transported to various sites or locations to sample the shade material 10 at the different locales. In this manner, the display tool 2 may demonstrate to a user or customer the functional (e.g., operation) and/or aesthetic (e.g., general appearance, translucence, texture, etc.) characteristics of the corresponding full-sized shade without installing the full-sized shade within the architectural opening.

The frame structure 4 may include a plurality of handles each adjacent a longitudinal edge of the frame structure 4 and formed with the frame structure 4 as a unitary structure. In some embodiments, the frame structure 4 includes a first side handle 12 adjacent a first longitudinal side edge 14 of the frame structure 4, a second side handle 16 adjacent a second longitudinal side edge 18 of the frame structure 4, and a top handle 20 adjacent a top longitudinal edge 22 of the frame structure 4. The side handles 12, 16 may each coextensively define first and second planar surfaces 24, 26 with first and second end walls 28, 30 of the frame structure 4, respectively, whereas the top handle 20 may project generally outwardly a distance away from a top end wall 32 of the frame structure 4. In this manner, the frame structure 4 may be supported on either the first or second end wall 28, 30 having either the first side handle 12 or the second side handle 16 defined therein, respectively.

The side handles 12, 16 may be centrally located on the first and second end walls 28, 30, respectively. A depth D1 of the side handles 12, 16 may be less than a depth D2 of the first and second end walls 28, 30, respectively, to provide space for a user to position their fingers at least partially around and grip the side handles 12, 16 without encroaching an outer envelope defined by the frame structure 4. The side handles 12, 16 may include a reinforcement rib 31 to strengthen the side handles 12, 16. In some embodiments, the side handles 12, 16 include rounded flanges or lips extending outwardly from the reinforcement rib 31, and the flanges at least partially define the first and second planar surfaces 24, 26. As more fully explained hereafter, the configuration of the side handles 12, 16 may facilitate removal of the display tool 2 from a storage container, which in some embodiments is sized to snugly receive the display tool 2 with front and rear surfaces of the end walls 28, 30, 32 abutted against inner surfaces of the storage container to minimize the overall size of the storage container. As shown, for example, in FIG. 8, the frame structure 4 may include a first frame 34 and a second frame 36 connected together at a line of separation 38 longitudinally bisecting the frame structure 4. The first frame 34 and the second frame 36 may be connected together by mechanical fasteners, corresponding retention features, adhesive, heat or sonic welding, or any other suitable attachment means.

Figure 14:
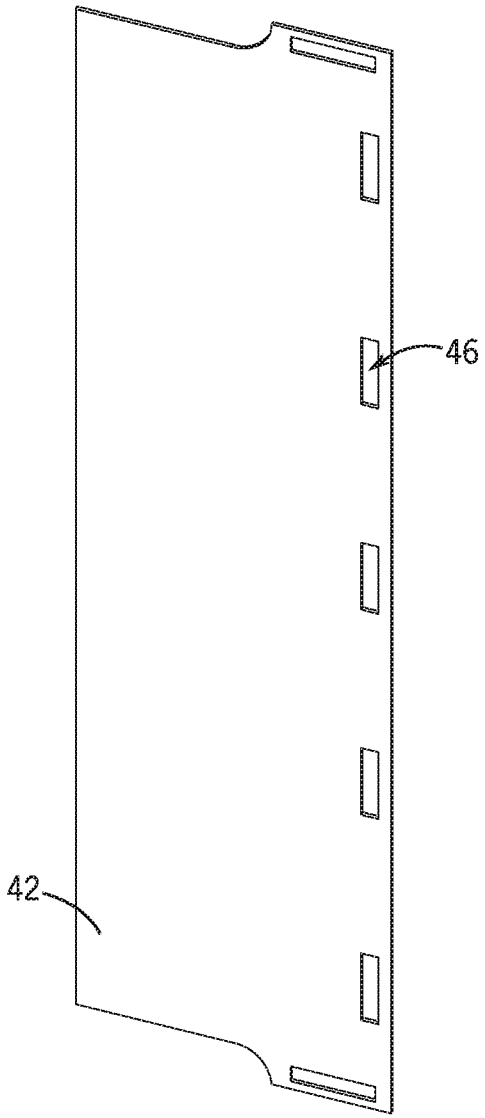
FIG. 14 is an isometric view of a soffit in accordance with an embodiment of the present disclosure.

With reference to FIGS. 1-6, the frame structure 4 may include an interior opening 40 configured to receive both a portion of each blade 8 and a portion of the shade material 10. As more fully explained below, the plurality of blades 8 may be movable within the interior opening 40 to display the shade material 10 in open and closed positions. For example, operation of the drive assembly 6 may rotationally displace the blades 8 within the interior opening 40 from a closed position (see FIGS. 1-3) to an open position (see FIGS. 5-7). Soffit members 42 may be positioned within the interior opening 40 and adjacent first and second inner longitudinal edges 44 of the frame structure 4. The soffit members 42 may have exterior dimensions sufficient to substantially fill the space between the first and second inner longitudinal edges 44 of the frame structure 4 and an adjacent blade 8, respectively. In this manner, light may pass through only the shade material 10 to better simulate the covering within an architectural opening. The soffit members 42 may be at least partially positioned between the first frame 34 and the second frame 36 and may be attached to one of the first frame 34 or the second frame 36 substantially at the line of separation 38 through corresponding retention features. For example, with specific reference to FIGS. 14 and 15, the soffit members 42 may include a plurality of openings 46 intermittently spaced adjacent a longitudinal edge(s), such as a top edge and/or a side edge. A plurality of corresponding projections 48 may extend outwardly from one of the first frame 34 or the second frame 36. Receipt of the plurality of projections 48 within the plurality of openings 46 may attach the soffit members 42 to the first frame 34 and limit translational movement of the soffit members 42 relative to the first frame 34 in two dimensions. Attachment of the second frame 36 to the first frame 34 may limit translational movement of the soffit members 42 in three dimensions. As more fully explained below, the soffit members 42 may limit the rotational displacement of the blades 8 during operation and help define a closed position of the display tool 2.

With continued reference to FIGS. 1-6, the shade material 10 may be attached to the plurality of blades 8 such that rotation of the blades 8 moves the shade material 10 between a closed position and an open position. As shown in FIGS. 4-7B, the shade material 10 may be wrapped about each of the blades 8. In some embodiments, the shade material 10 may be a continuous sheet of material that loops around and connects each of the plurality of blades 8. In some embodiments, the shade material 10 may not wrap about the blades 8, but instead is attached to only a longitudinal edge of each blade 8, such as a first edge 50. As can be seen by comparing FIG. 4 with FIG. 7, in a closed position, the shade material 10 may at least partially overlap to form a plurality of vertically-disposed, horizontally-spaced loops of material 52 each having substantially teardrop-shaped cross-sections. In an open position, each of the loops of material 52 may expand transversely to form a substantially C-shaped cross-section. While described herein with reference to vertically-disposed loops of material 52, the display tool 2 may be configured such that the shade material droops downwardly to form a plurality of horizontally-disposed, vertically-spaced loops of material having the characteristics described above.

Figure 7:
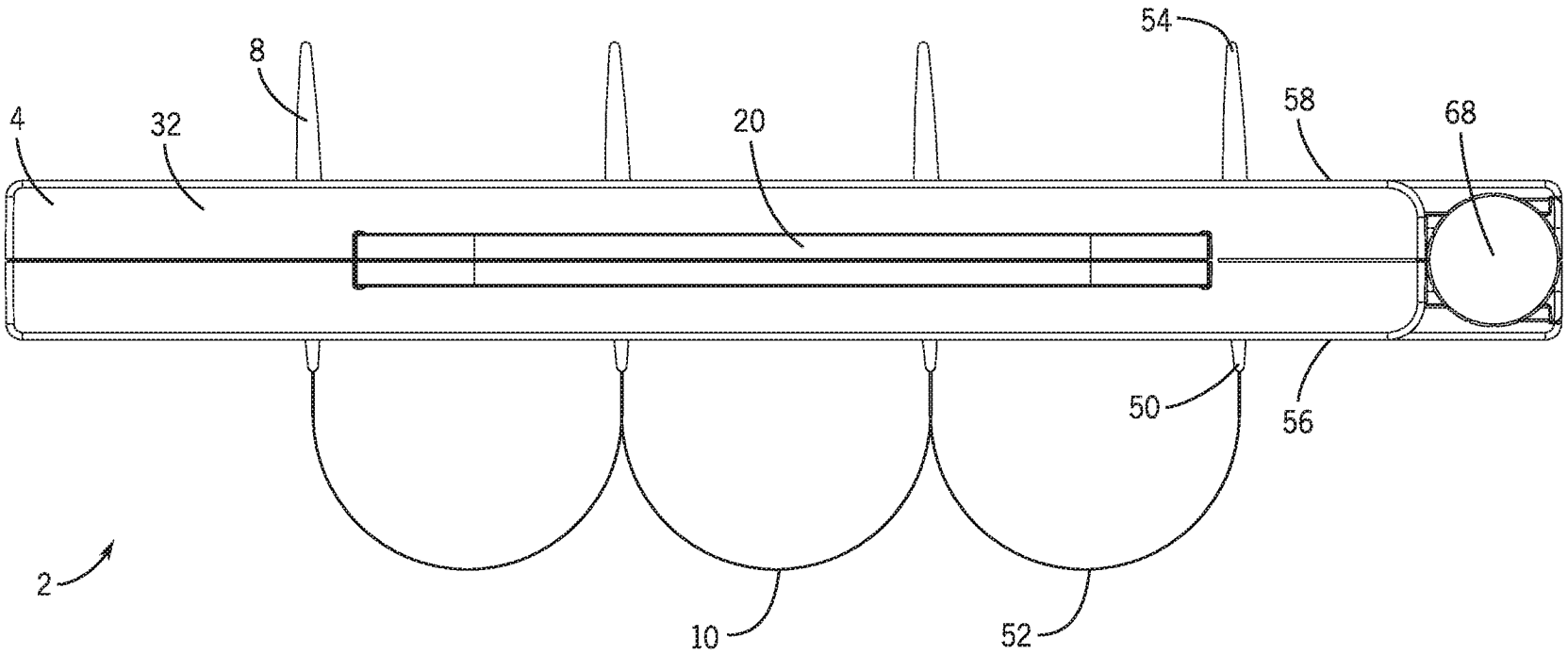
FIG. 7 is a top plan view of the display tool of FIG. 5 in accordance with some embodiments of the present disclosure.

With reference to FIGS. 4-7, in a closed position, the first edge 50 of at least one of the blades 8 may be adjacent or overlap a second longitudinal edge 54 of an adjacent blade 8. As best seen in FIG. 7, in an open position, the first edge 50 may extend a first distance away from a first end wall 56 of the frame structure 4, and the second edge 54 may extend a second distance away from a second end wall 58 of the frame structure 4 opposite the first end wall 56. In some embodiments, the second distance may be greater than the first distance. In the open position, the plurality of blades 8 may extend substantially perpendicular to the first and second end walls 56, 58, whereas in the closed position, the plurality of blades 8 may extend substantially parallel to the first and second end walls 56, 58. Additionally or alternatively, a second shade material (not shown) may extend from the second edge 54 of each blade 8. For example, a Roman-type shade may extend from the first edge 50 whereas a generally planar backing sheet may extend from the second edge 54 to better simulate covering products. Although reference is given to a Roman-type shade, it is contemplated that any type of shade may be similarly configured to attach to the blades 8.

The shade material 10 may be constructed of substantially any type of material. For example, the shade material 10 may be constructed from natural and/or synthetic materials, including fabrics, polymers, and/or other suitable materials. Fabric materials may include woven, non-woven, knits, or other suitable fabric types. The shade material 10 may have any suitable level of light transmissivity. For example, the shade material 10 may be constructed of transparent, translucent, and/or opaque materials to provide a desired ambience or décor in an associated room. In some embodiments, portions of the shade material 10 may be made from a sheet of material with zero light transmissivity, often referred to as a black-out material. The shade material 10 may include a single layer of material or multiple layers of material connected together. The shade material 10 may have a high level of drape (less stiff) or a low level of drape (more stiff), which may be selected for obtaining an appropriate shade shape.

Figure 8:
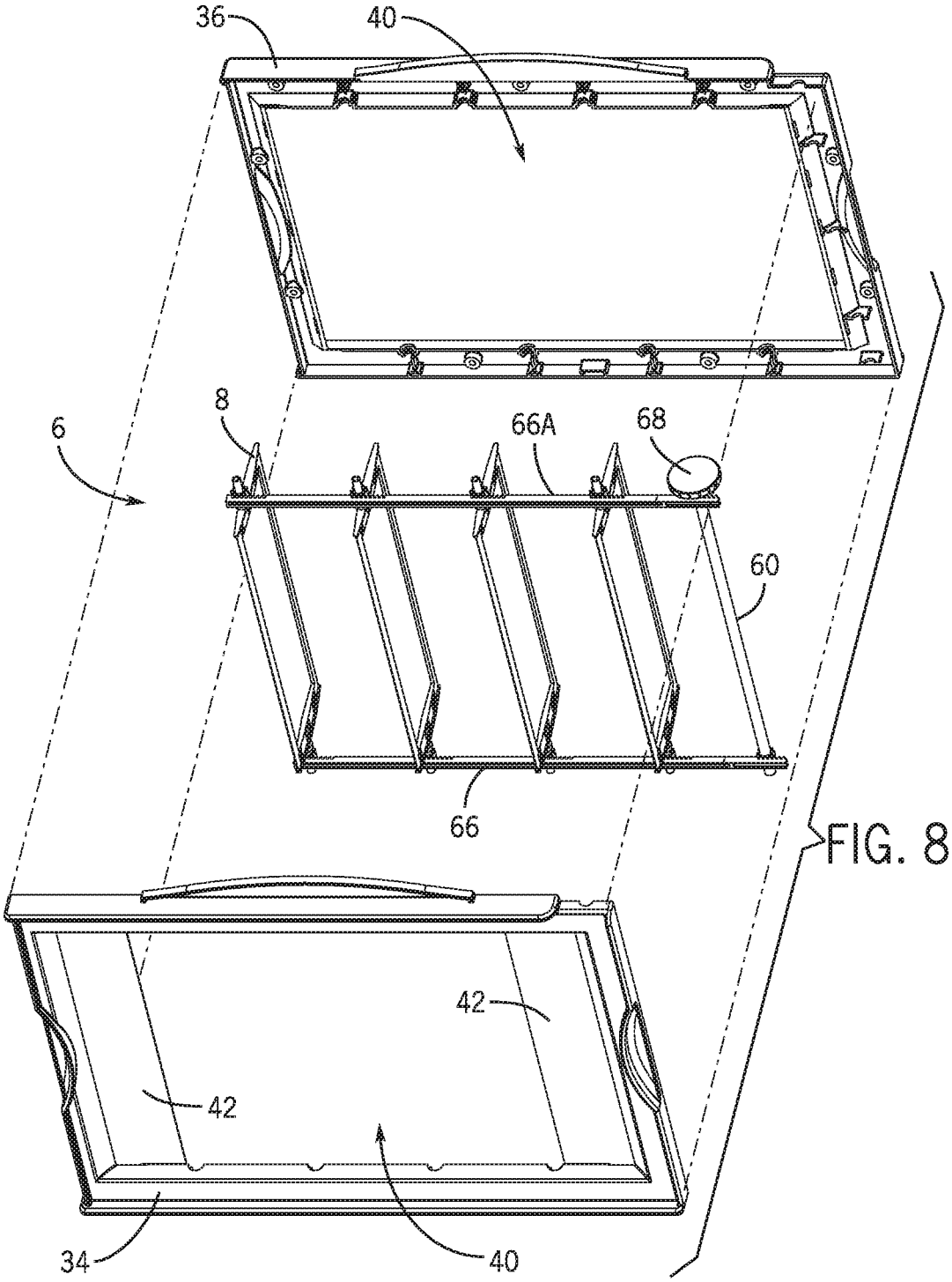
FIG. 8 is an exploded isometric view of display tool components in accordance with an embodiment of the present disclosure.

With reference to FIGS. 8-11, the display tool 2 may include a drive assembly 6 operatively connected to the frame structure 4 to selectively move the shade material 10 from a closed position to an open position to permit a user to assess qualities of the covering sample based on the angular orientation and the characteristics of the shade material 10. In some embodiments, the drive assembly 6 may include a rotatable crank member 60 having a drive sprocket 62, a pinion gear 64 attached to each blade 8, and a first rack member 66A displaceable along a longitudinal length of the frame structure 4 and operatively connected with the drive sprocket 62 and each of the pinion gears 64, e.g., through meshing gear/sprocket engagement. In the open position, the first rack member 66A may be positioned substantially between the pinion gear 64 and the first longitudinal edge 50 of each blade 8. As will be appreciated more fully below, actuation of the drive assembly 6 may rotate the crank member 60 to displace the first rack member 66A along the longitudinal length of the frame structure 4 and rotate each of the pinion gears 64 and rotationally displace each of the blades 8 within the interior opening 40 of the frame structure 4. For example, rotation of the crank member 60 in a first rotational direction (e.g., clockwise in FIG. 11) rotates the drive sprocket 62 in the first rotational direction to move the first rack member 66A in a first direction (e.g., towards the drive sprocket 62). Displacement of the first rack member 66A in the first direction may rotate each pinion gear 64 and an associated blade 8 in the first rotational direction. In like manner, rotation of the crank member 60 in a second rotational direction (e.g., counterclockwise in FIG. 11) may rotate the drive sprocket 62 in the second rotational direction to move the first rack member 66A in a second direction (e.g., away from the drive sprocket 62) and rotate each pinion gear 64 and an associated blade 8 in the second rotational direction. As shown in FIG. 8, the drive assembly 6 may be positioned substantially between the first frame 34 and the second frame 36. To operate the drive assembly 6, the crank member 60 may include an actuation element 67, such as a crank handle 68, mounted on a side of the frame structure 4. In one embodiment, the actuation element 67 may be positioned exterior to the frame structure 4. In some embodiments, the actuation element 67 (e.g., the crank handle 68) may be configured for engagement by a user's hand. For example, the crank handle 68 may include a knurled outer surface to provide sufficient grip for a user's fingers. In some embodiments, the drive assembly 6 may include a plurality of rack members 66, each of the plurality of rack members 66 positioned adjacent opposing ends of the blade 8 and configured similarly to the first rack member 66A. In such embodiments, each blade 8 may include a plurality of pinion gears 64 operably connected to the plurality of rack members 66.

Figure 9:
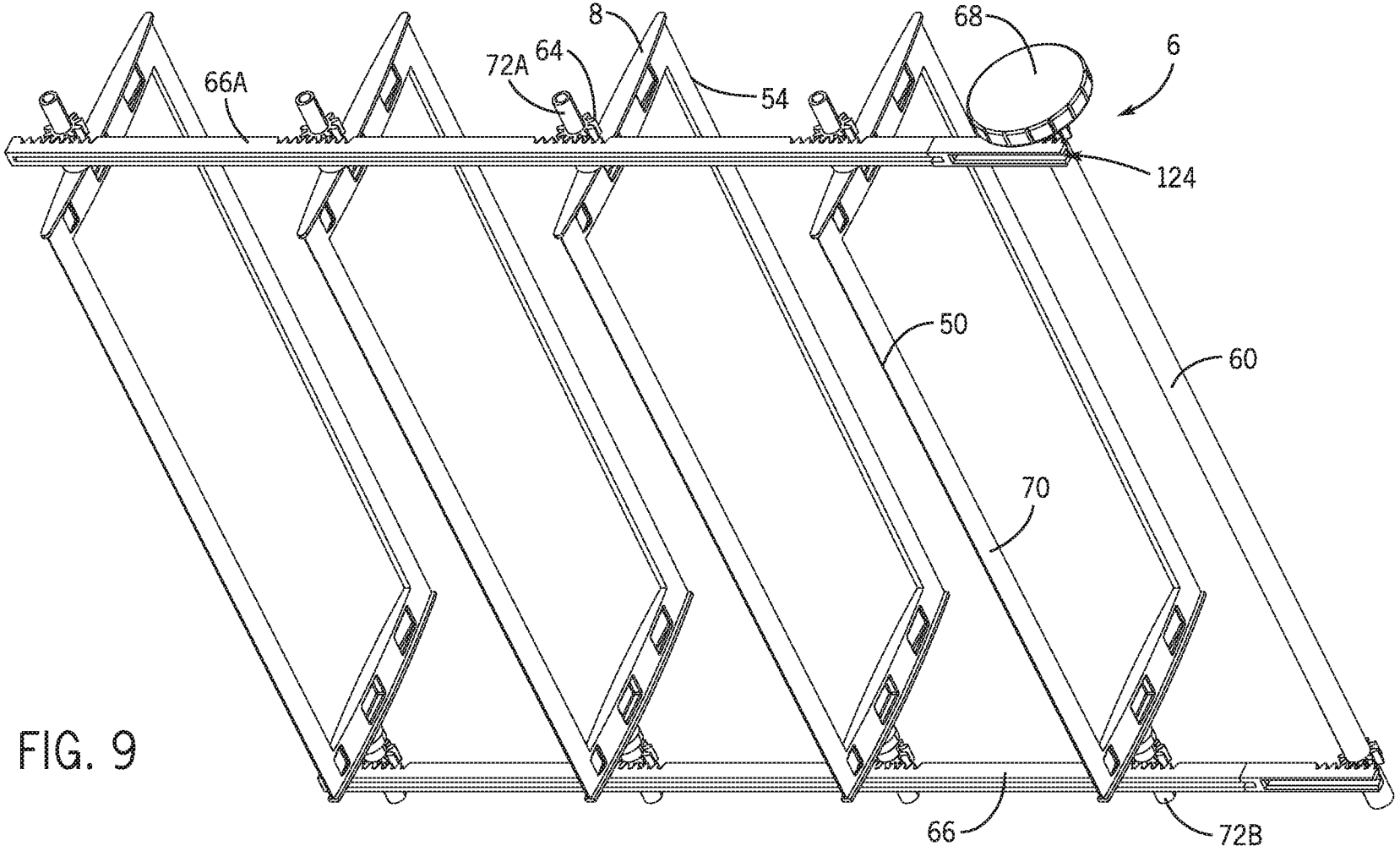
FIG. 9 is an isometric view of drive assembly components in accordance with an embodiment of the present disclosure.
Figure 10:
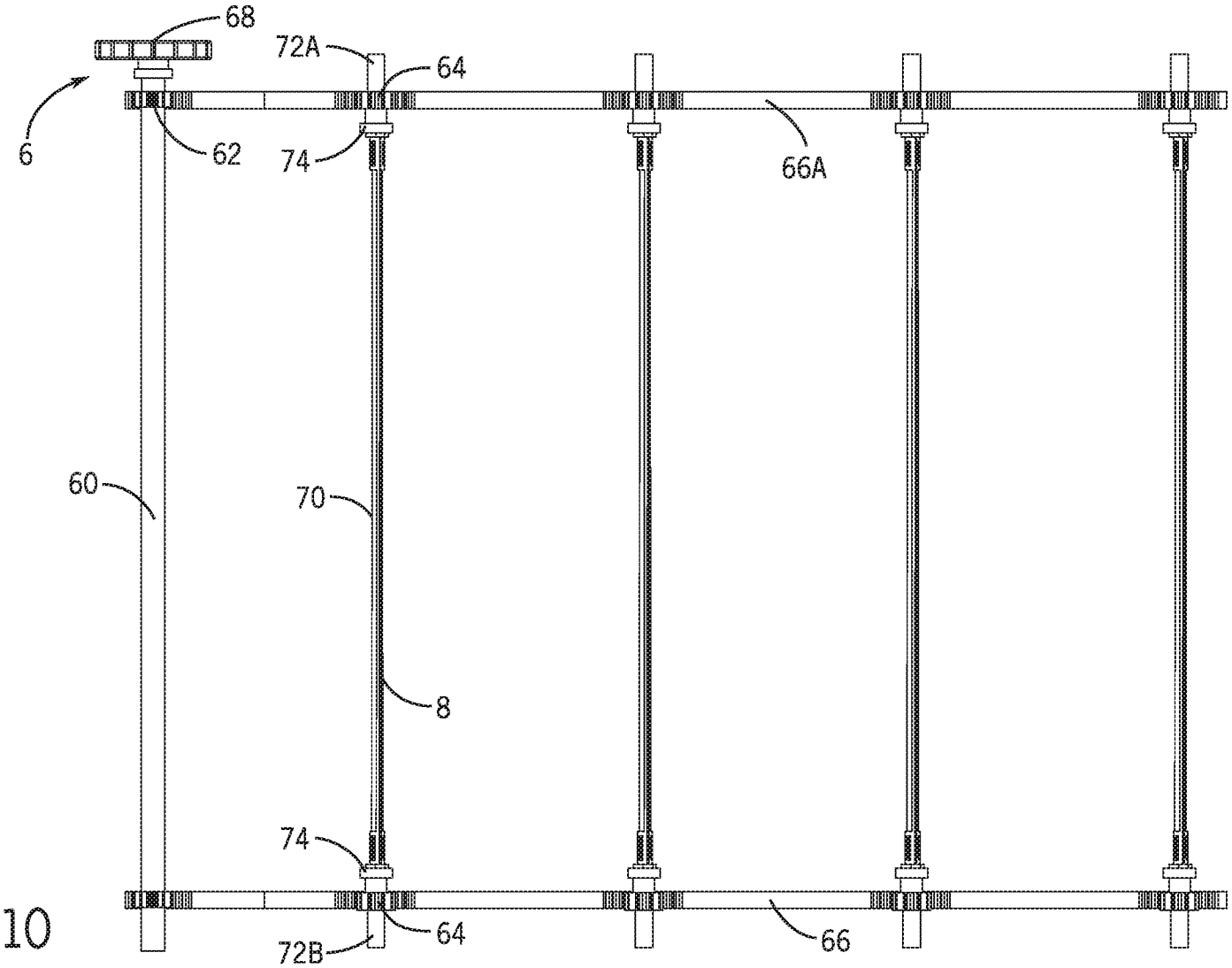
FIG. 10 is a rear elevation view of the drive assembly components of FIG. 9 in accordance with an embodiment of the present disclosure.
Figure 11:
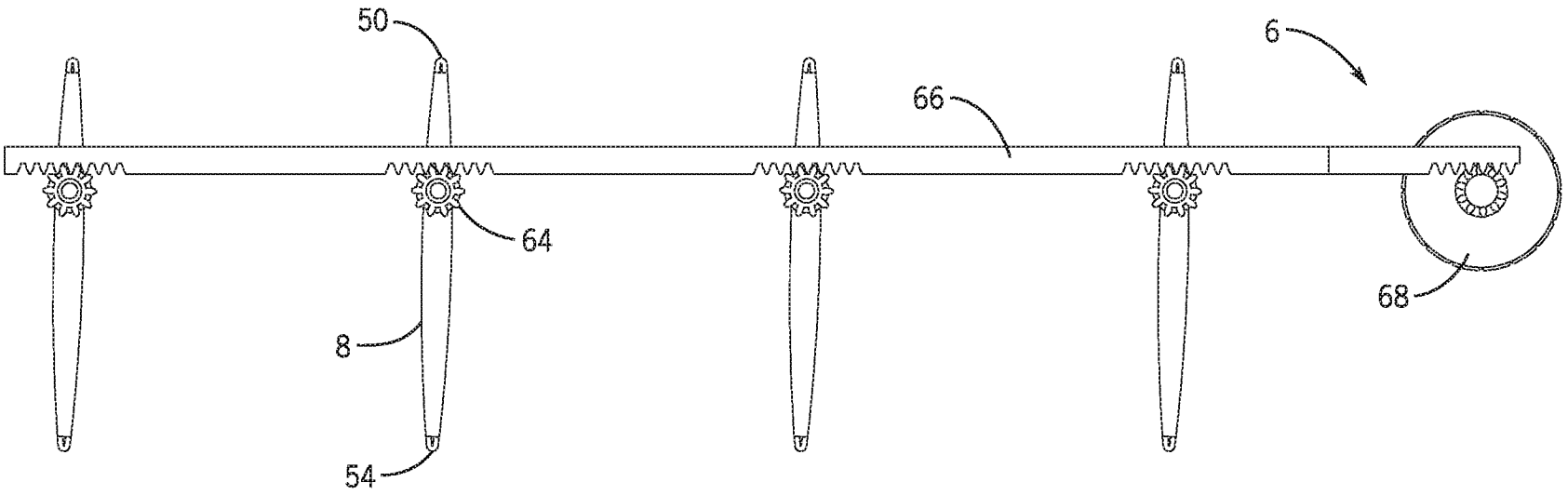
FIG. 11 is a bottom plan view of the drive assembly components of FIG. 9 in accordance with an embodiment of the present disclosure.
Figure 12:
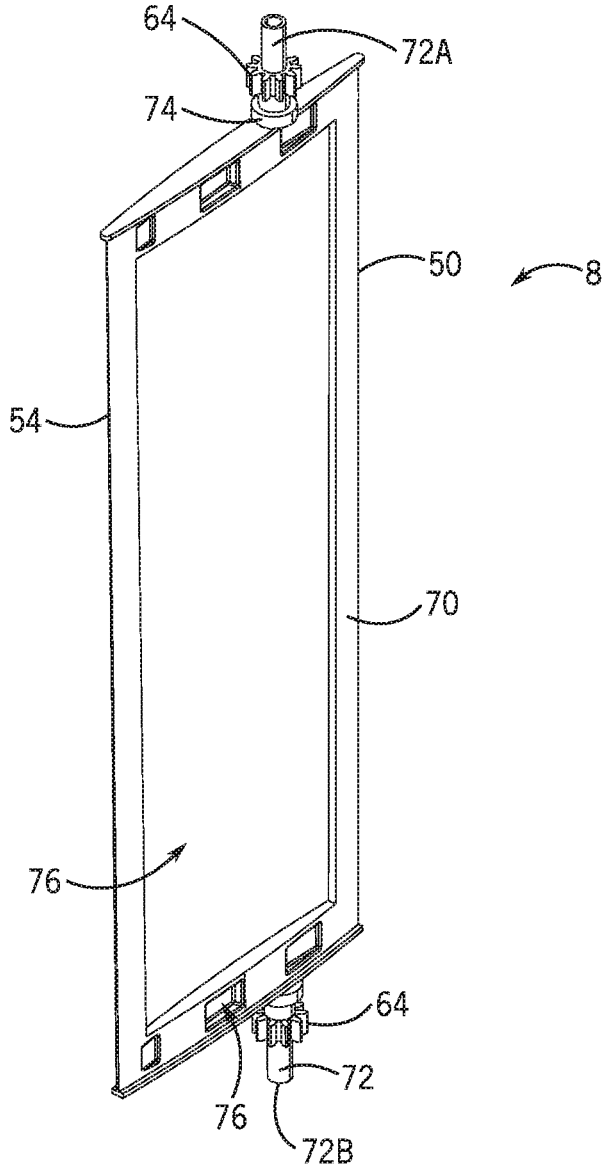
FIG. 12 is an isometric view of a blade component in accordance with an embodiment of the present disclosure.
Figure 13:
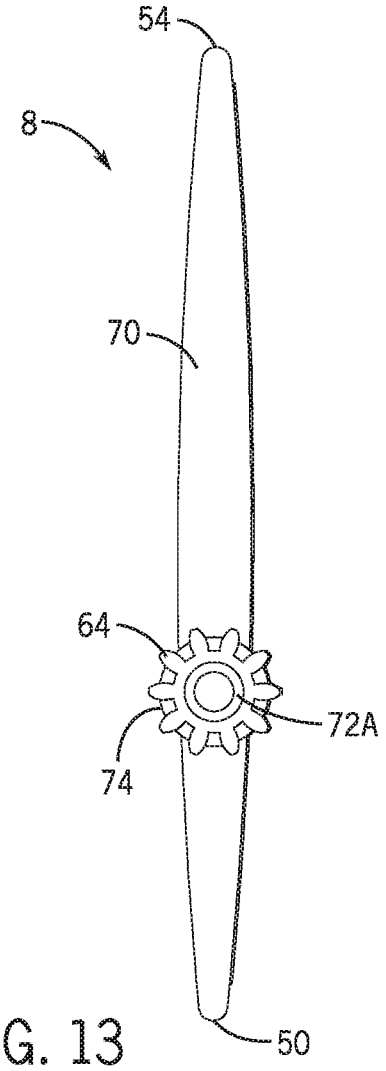
FIG. 13 is a top plan view of the blade component of FIG. 12 in accordance with an embodiment of the present disclosure.

With reference to FIGS. 9-13, each blade 8 may include a main body 70, at least one boss 72 extending outwardly from an end of the main body 70 along a longitudinal length of the main body 70, and a collar 74 attached to the at least one boss 72 and having a diameter greater than a diameter of the at least one boss 72. The pinion gear 64 may be attached to (e.g., rotatably mounted on) the at least one boss 72 substantially between the collar 74 and an end of the boss 72. In some embodiments, the main body 70 may be a parallelogram such as a rectangle having a length and a width sized to substantially fill the interior opening 40 of the frame structure 4 when the blades 8 are in the closed position. As shown in FIG. 10, the main body 70 may have a thickness less than a diameter of the boss 72. With reference to FIGS. 11 and 13, the main body 70 may have a substantially symmetrical airfoil or wing shape in cross section. The shade material 10 may be attached to the main body 70 of each blade 8. As shown, the main body 70 may include a plurality of openings 76 defined therein to reduce the weight of each blade 8.

In some embodiments, a first boss 72A and a second boss 72B may extend outwardly from opposing ends of the main body 70 offset from the longitudinal centerline of the main body 70. For example, as shown in FIG. 13, the first and second bosses 72A, 72B extend outwardly from an end of the main body 70 substantially midway between the longitudinal centerline of the main body 70 and the first longitudinal edge 50 of the blade 8. In such embodiments, the distance between the first and second bosses 72A, 72B and the first longitudinal edge 50 is less than the distance between the first and second bosses 72A, 72B and the second longitudinal edge 54. Although the first and second bosses 72A, 72B are shown to be substantially identical, it is contemplated that the first boss 72A and the second boss 72B may have different dimensions.

Figure 15:
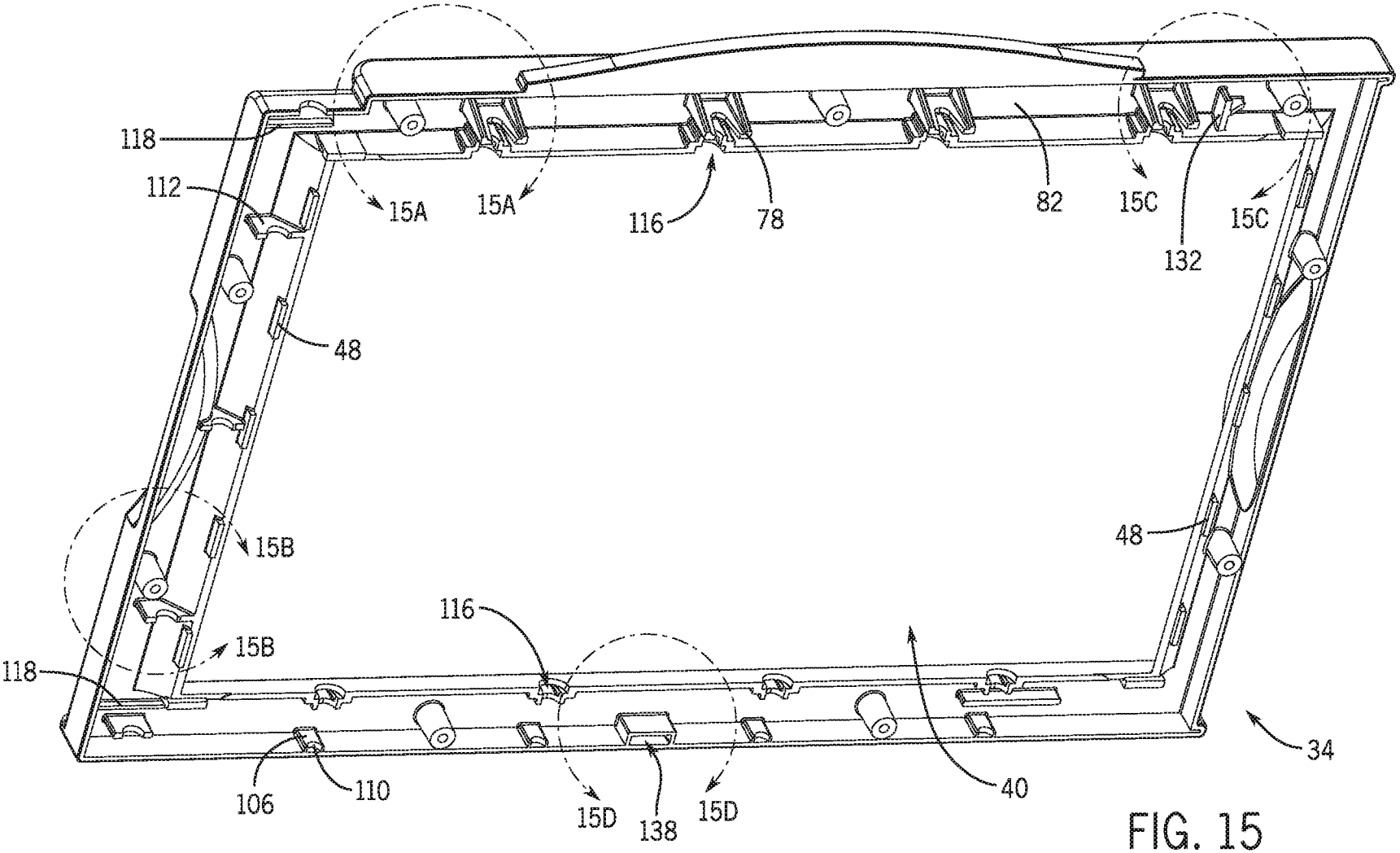
FIG. 15 is an isometric view of a first frame in accordance with an embodiment of the present disclosure.
Figure 15A:
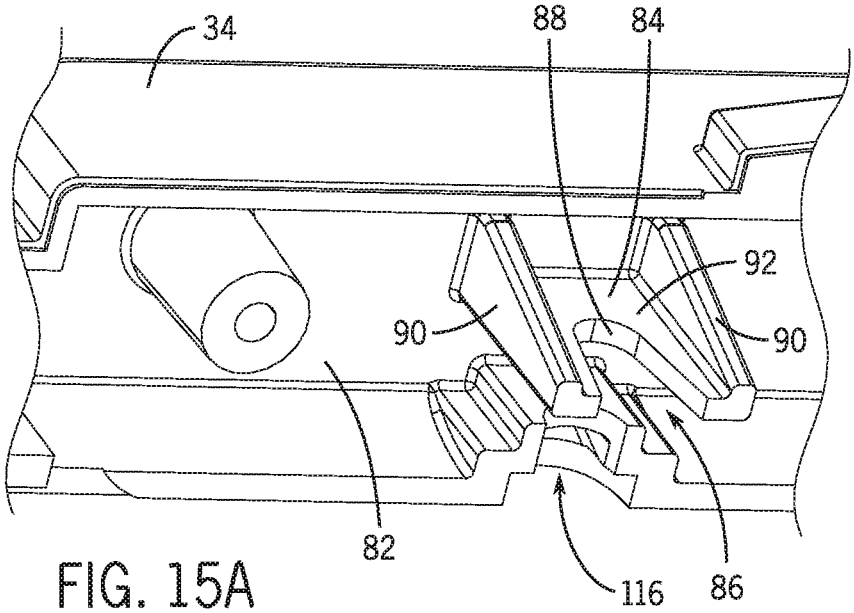
FIG. 15A is an enlarged, fragmentary isometric view of the first frame of FIG. 15 taken along detail line 15A-15A of FIG. 15 in accordance with an embodiment of the present disclosure.

With reference to FIGS. 9, 15-15C, and 16-18, the first rack member 66A, the blades 8, and the frame structure 4 may include alignment features to displaceably position the blades 8 and the drive assembly 6 within the frame structure 4. As shown in FIGS. 15-15A and 16-17B, the first frame 34 may include a first bearing structure 78 and the second frame 36 may include a second bearing structure 80 to correspondingly rotatably support each of the blades 8 by, for example, receipt of the first boss 72A rotatably within the first and second bearing structures 78, 80. With reference to FIGS. 15-15A, the first bearing structure 78 may extend outwardly from an interior surface 82 of the first frame 34 towards the second frame 36. In some embodiments, the first bearing structure 78 may include a wall 84 extending generally transversely to the longitudinal axis of the first boss 72A and having a cutout 86 defined in a top portion thereof. The cutout 86 may taper inwardly with distance away from a top surface of the wall 84 and have a semi-cylindrical bearing surface 88 defined in the bottom thereof sized to substantially match an outer diameter of the first boss 72A. A pair of flanges 90 may extend substantially perpendicularly to an outer face 92 of the wall 84 and away from the interior opening 40 of the frame structure 4. As shown, the cutout 86 may be positioned between the pair of flanges 90.

Figure 17:
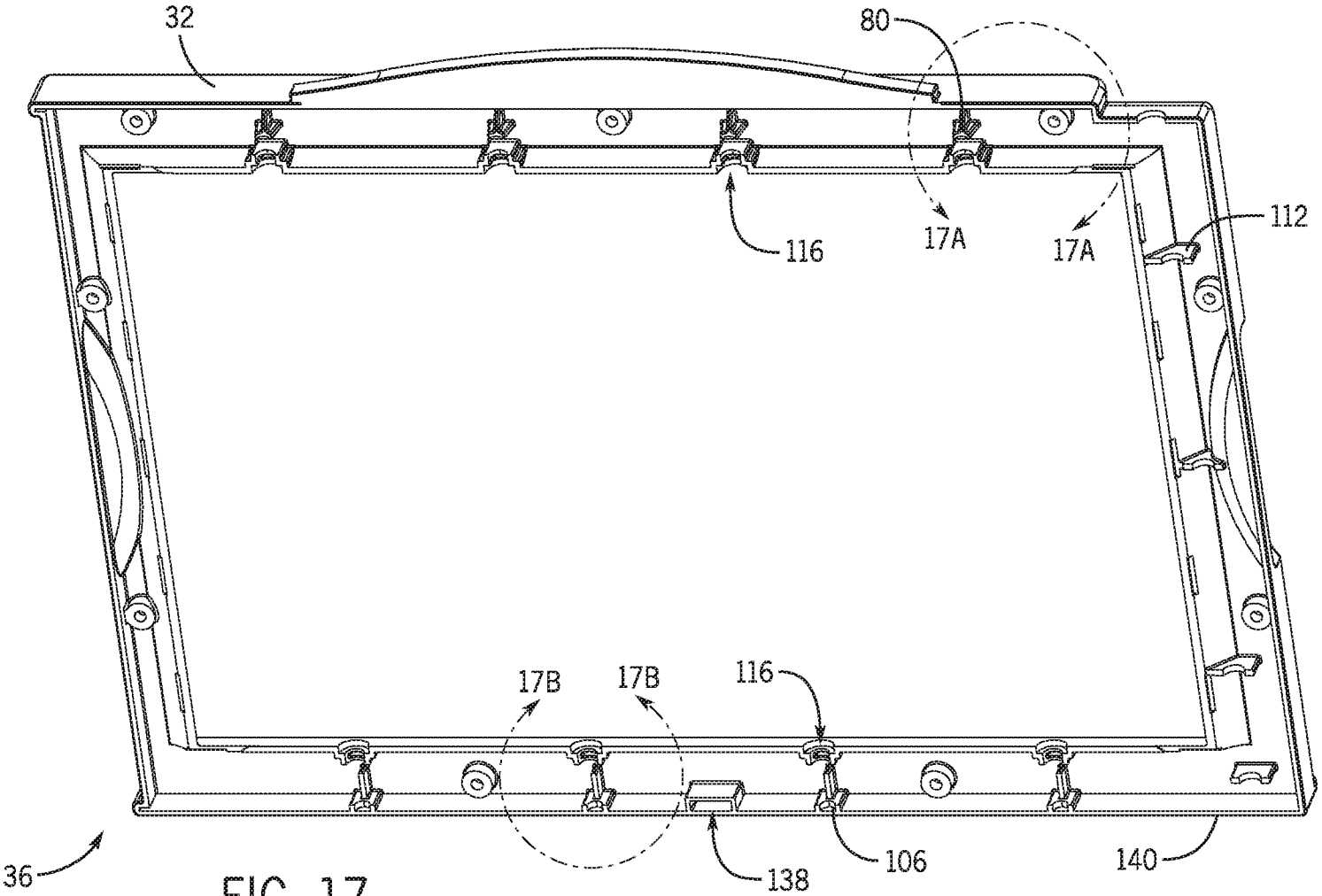
FIG. 17 is an isometric view of a second frame in accordance with an embodiment of the present disclosure.
Figure 17A:
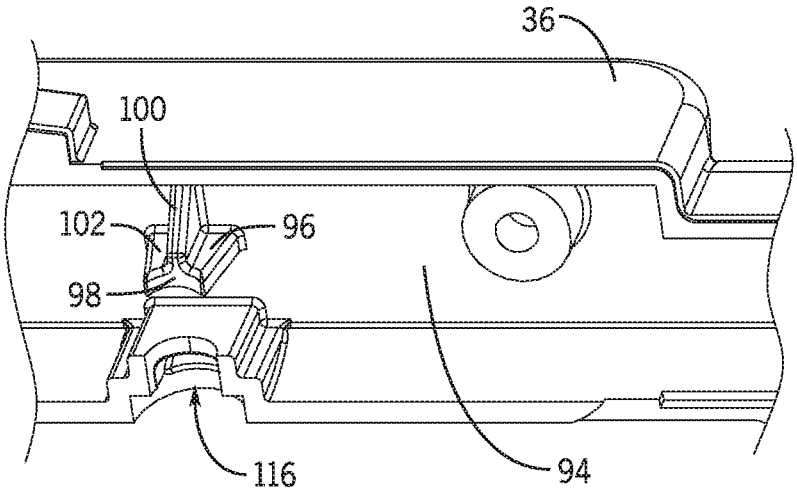
FIG. 17A is an enlarged, fragmentary isometric view of the second frame of FIG. 17 taken along detail line 17A-17A of FIG. 17 in accordance with an embodiment of the present disclosure.

With reference to FIGS. 17 and 17A, the second bearing structure 80 may extend outwardly from an interior surface 94 of the second frame 36 towards the first frame 34. The second bearing structure 80 may include a wall 96 extending generally transversely to the longitudinal axis of the first boss 72A and tapering inwardly with distance away from the interior surface 94 of the second frame 36. The taper of the wall 96 may generally match the inward taper of the cutout 86. The top surface of the second bearing structure 80 may define a semi-cylindrical bearing surface 98 sized to substantially match an outer diameter of the first boss 72A. The second bearing structure 80 may include a flange 100 extending perpendicularly to an outer face 102 of the wall 96 and away from the interior opening 40 of the frame structure 4.

Figure 17B:
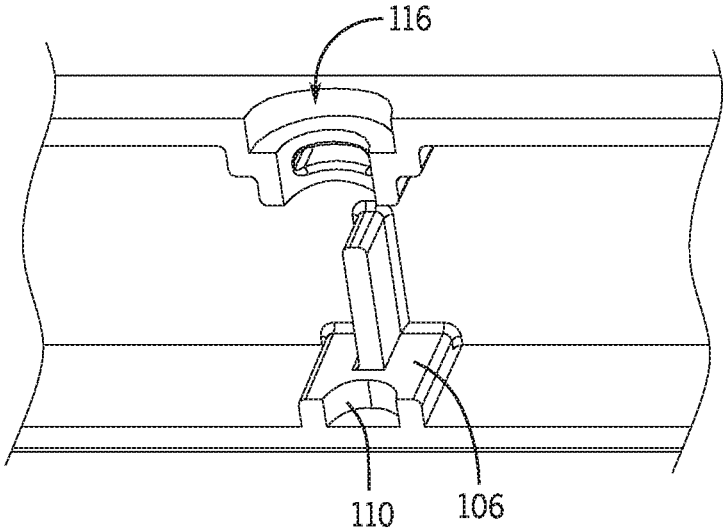
FIG. 17B is an enlarged, fragmentary isometric view of the first frame of FIG. 17 taken along detail line 17B-17B of FIG. 17 in accordance with an embodiment of the present disclosure.
Figure 18:
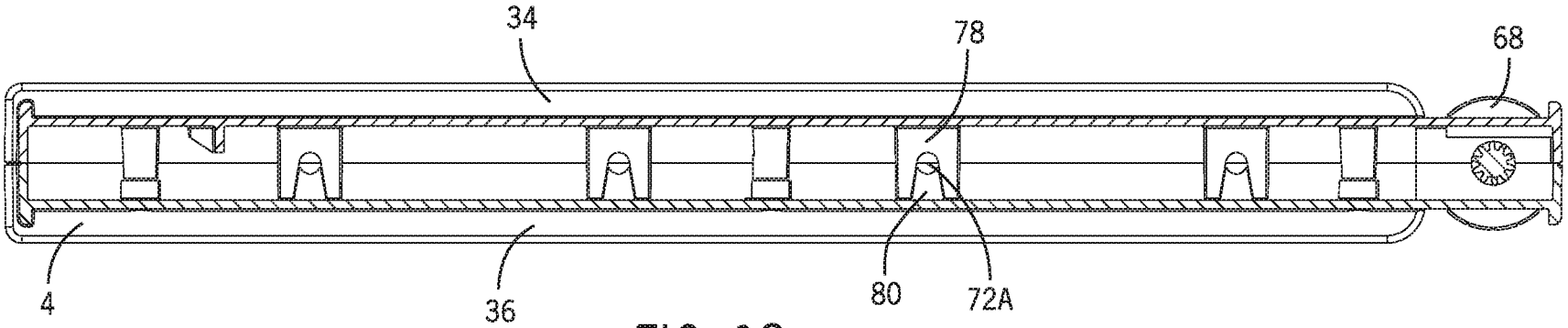
FIG. 18 is a cross-sectional view of the display tool of FIG. 1 taken along line 18-18 of FIG. 3 in accordance with an embodiment of the present disclosure.
Figure 19:
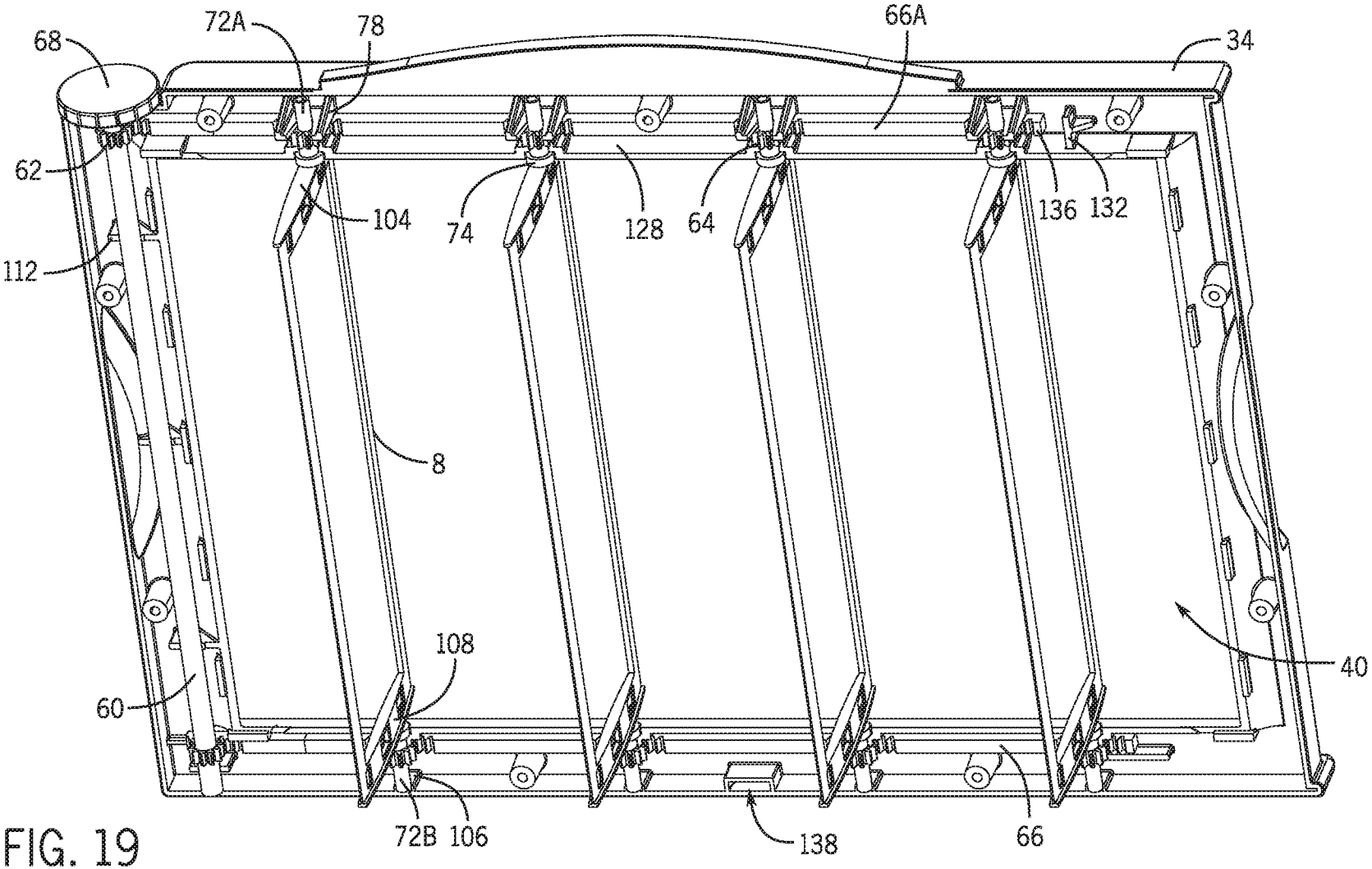
FIG. 19 is a rear isometric view of the display tool of FIG. 5 with a second frame and a shade material removed in accordance with an embodiment of the present disclosure.
Figure 20:
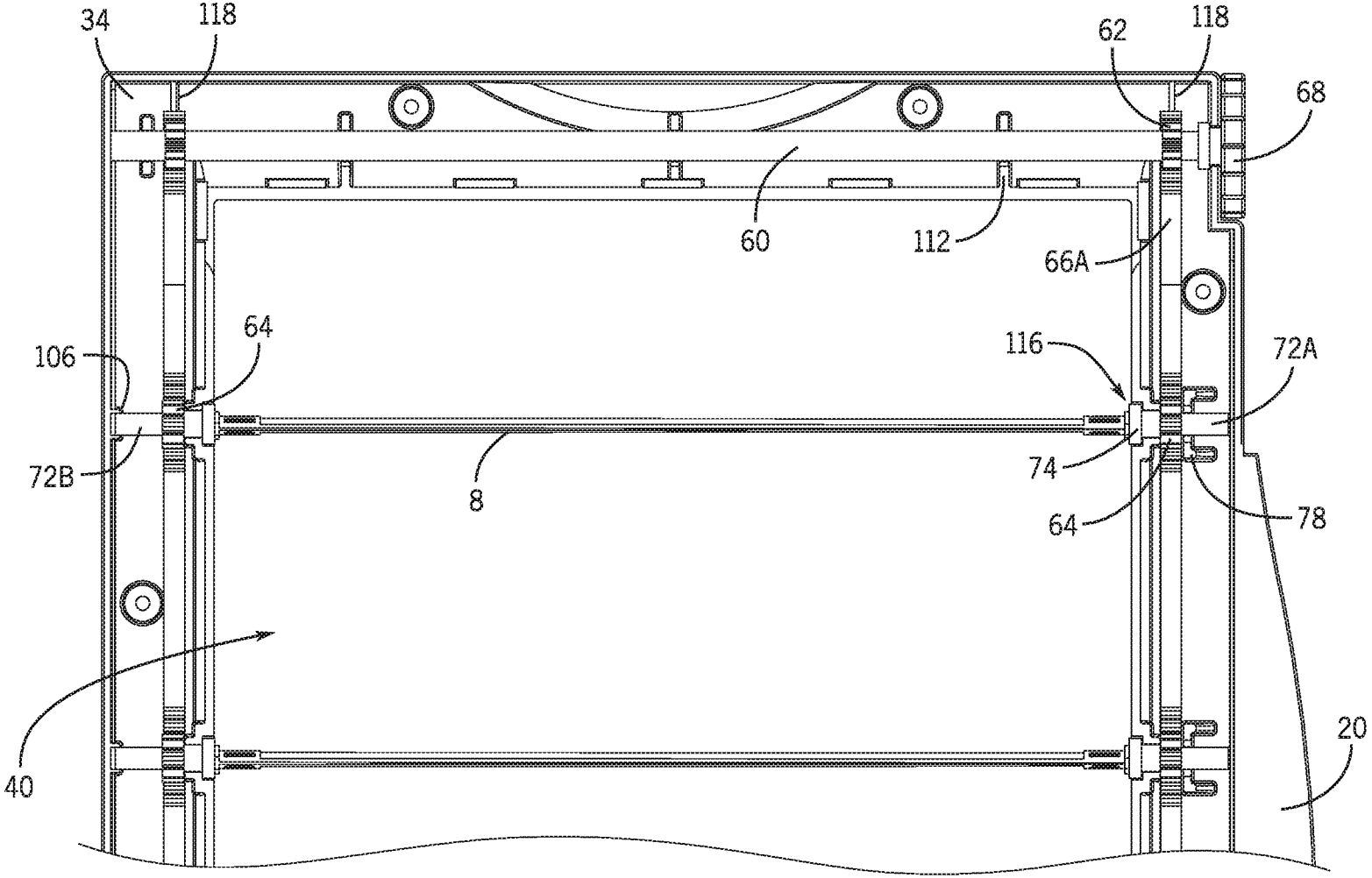
FIG. 20 is an enlarged, fragmentary elevation view of the display tool of FIG. 19 in accordance with an embodiment of the present disclosure.

Referring now to FIG. 18, when the first frame 34 is connected to the second frame 36, the second bearing structure 80 may be received within the cutout 86 of the first bearing structure 78 to rotatably support the blades 8 between the first frame 34 and the second frame 36. For example, together, the semi-cylindrical bearing surfaces 88, 98 of the first and second bearing structures 78, 80 may substantially surround the first boss 72A to rotatably support a first end 104 of each blade 8. With reference to FIGS. 15, 17, and 17B, the first frame 34 and the second frame 36 may each include third bearing structures 106 to rotatably support a second end 108 of each blade 8 within the frame structure 4. The third bearing structures 106 may include corresponding semi-cylindrical bearing surfaces 110 sized to substantially match a diameter of the second boss 72B. When the first frame 34 is connected to the second frame 36, the corresponding bearing surfaces 110 of the third bearing structure 106 may substantially surround the second boss 72B to rotatably support the second end 108 of the blade 8.

Figure 15B:
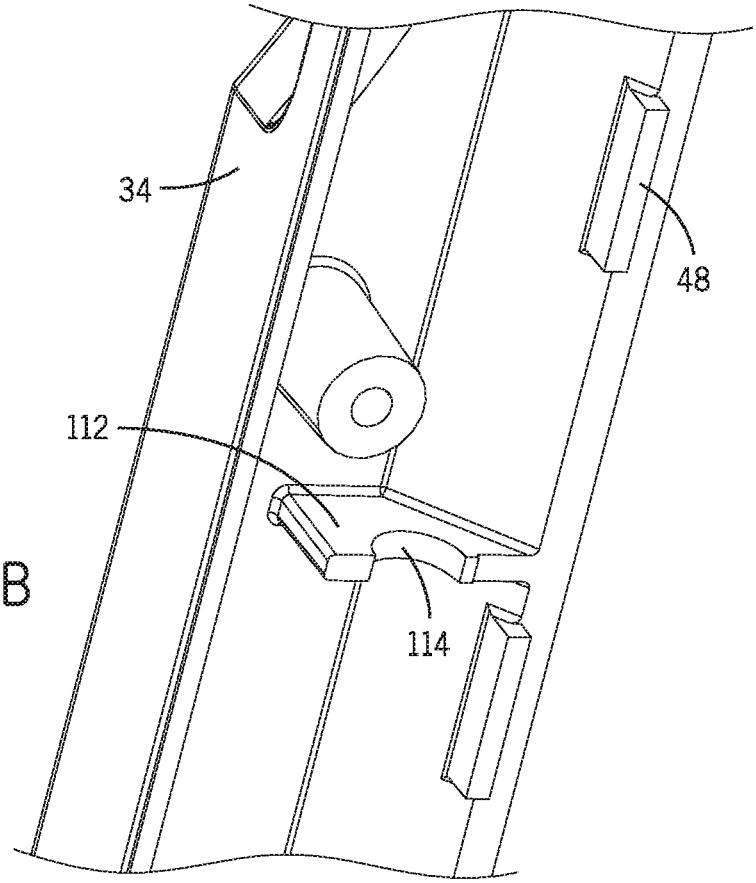
FIG. 15B is an enlarged, fragmentary isometric view of the first frame of FIG. 15 taken along detail line 15B-15B of FIG. 15 in accordance with an embodiment of the present disclosure.

As shown in FIGS. 15, 15B, and 17, the first frame 34 and the second frame 36 may each include at least one fourth bearing structure 112 having a bearing surface 114 to rotatably support the crank member 60 within the frame structure 4. For example, the bearing surfaces 114 may be corresponding semi-cylindrical surfaces sized to substantially match a diameter of the crank member 60. When the first frame 34 is connected to the second frame 36, the corresponding bearing surfaces 114 of the first frame 34 and the second frame 36 may substantially surround the crank member 60 to rotatably support the crank member 60. During operation, the crank member 60 may rotatably bear against each of the bearing surfaces 114 of the first frame 34 and the second frame 36.

With reference to FIGS. 15, 15A, 16, and 17-17B, the first frame 34 and the second frame 36 may each include an alignment slot 116 adjacent the interior opening 40 of the frame structure 4 to position each blade 8 longitudinally within the interior opening 40. For example, the alignment slot 116 may be configured to receive the collar 74 of the blade 8 and reduce or control planar movement of the blade 8 relative to the frame structure 4 while simultaneously permitting rotational movement of the blade 8 within the interior opening 40 of the frame structure 4. In some embodiments, the collar 74 may rotatably bear against the alignment slot 116 to rotatably support the blade 8. The alignment slot 116 may be coaxially aligned with, and positioned inwardly from, the bearing surface 88 of the first bearing structure 78. In some embodiments, a pair of alignment slots 116 diametrically opposed to each other across the interior opening 40 of the frame structure 4 may longitudinally position a blade 8 within the interior opening 40. The frame structure 4 may include a pair of opposing alignment slots 116 for each of a plurality of blades 8.

Figure 15C:
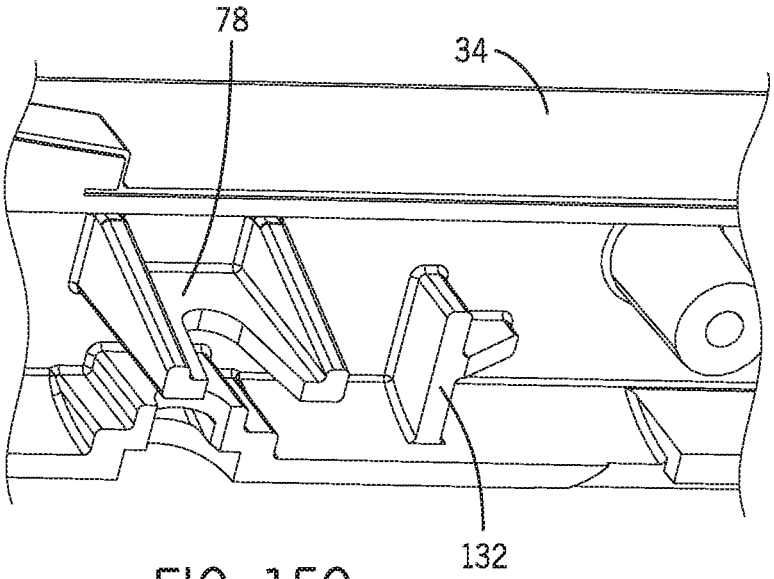
FIG. 15C is an enlarged, fragmentary isometric view of the first frame of FIG. 15 taken along detail line 15C-15C of FIG. 15 in accordance with an embodiment of the present disclosure.
Figure 15D:
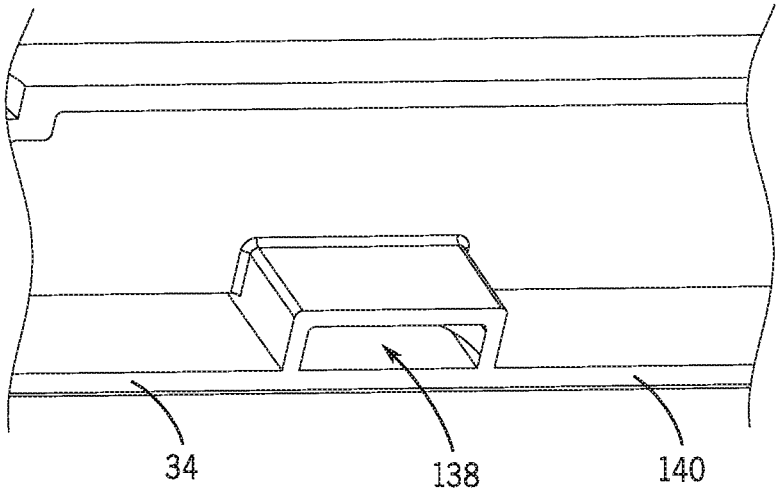
FIG. 15D is an enlarged, fragmentary isometric view of the first frame of FIG. 15 taken along detail line 15D-15D of FIG. 15 in accordance with an embodiment of the present disclosure.
Figure 16:
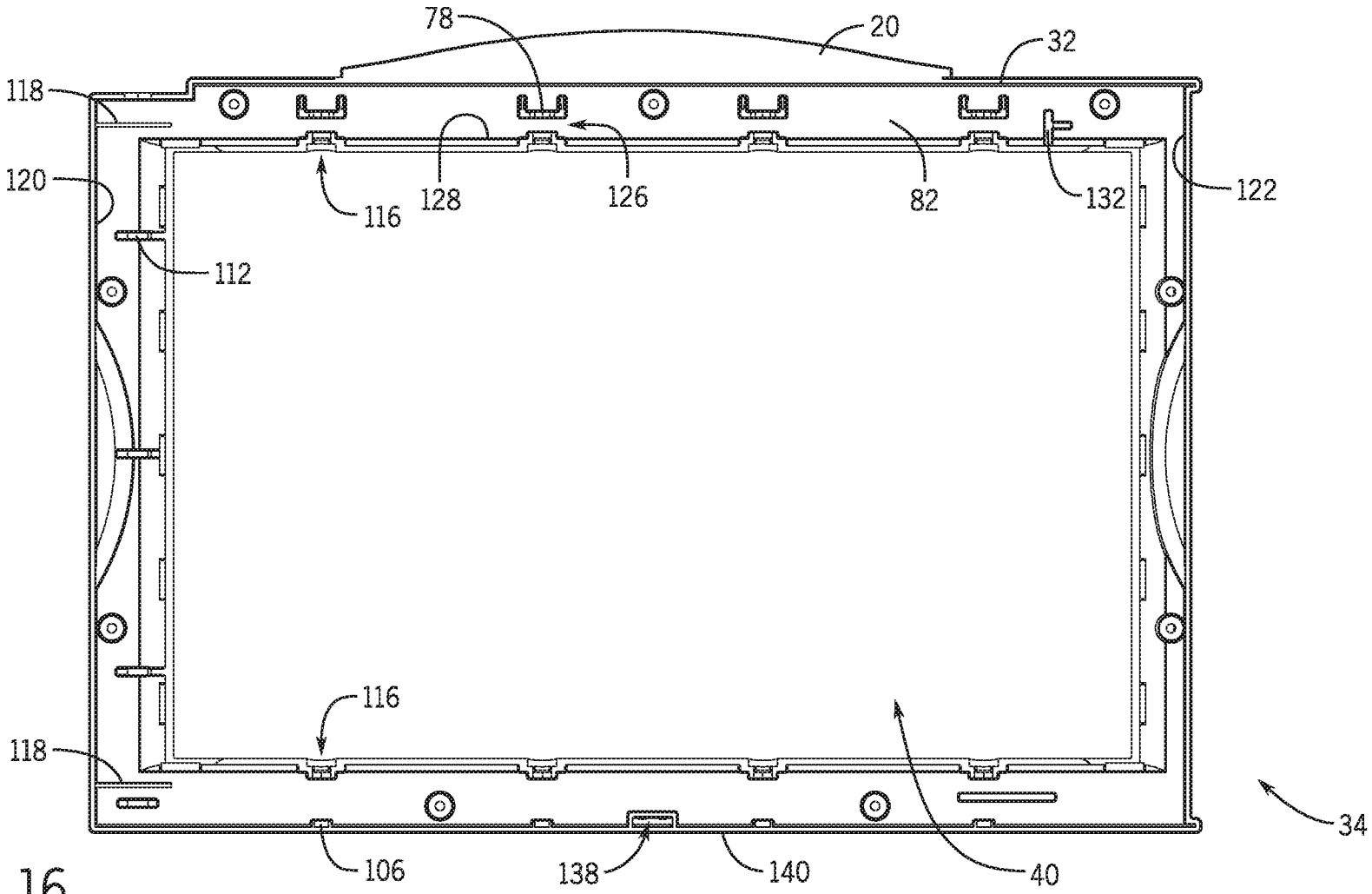
FIG. 16 is a front elevation view of the first frame of FIG. 17 in accordance with an embodiment of the present disclosure.

As shown in FIGS. 15 and 16, the first frame 34 may include at least one rail 118 extending outwardly from the interior surface 82 of the first frame 34 towards the second frame 36 along a longitudinal length of the first frame 34 and substantially perpendicular to a first wall 120 of the first frame 34. In some embodiments, the rail 118 may extend inwardly a distance from the first wall 120 towards a second wall 122 opposite the first wall 120. With reference to FIG. 9, the first rack member 66A may include a slot 124 extending along a longitudinal length of the first rack member 66A and sized to receive the rail 118 therein. In some embodiments, receipt of the rail 118 within the slot 124 longitudinally aligns the first rack member 66A within the frame structure 4. The first rack member 66A may be received within a channel 126 substantially defined within the first frame 34 at least in part by a plurality of first bearing structures 78 and an interior wall 128 adjacent a plurality of alignment slots 116. For example, the first rack member 66A may slidably abut against both the interior wall 128 and an inner face 130 of the wall 84 of the first bearing structure 78. With reference to FIG. 15C, the first frame 34 may include at least one abutment wall 132 extending outwardly from the interior surface 82 of the first frame 34 towards the second frame 36 and positioned nearer the second wall 122. As explained more fully below, the abutment wall 132 may restrict displacement of the first rack member 66A longitudinally within the channel 126 away from the first wall 120.

Figure 21:
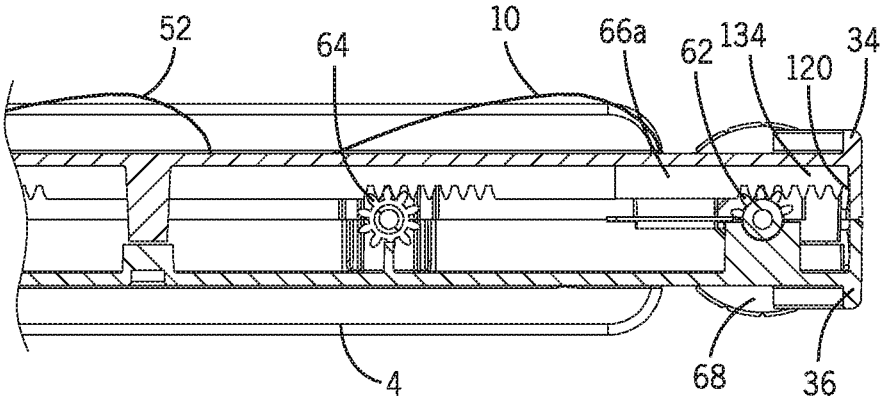
FIG. 21 is an enlarged, fragmentary view of a cross-section of the display tool of FIG. 1 taken along line 21-21 of FIG. 3 in accordance with an embodiment of the present disclosure.
Figure 22:
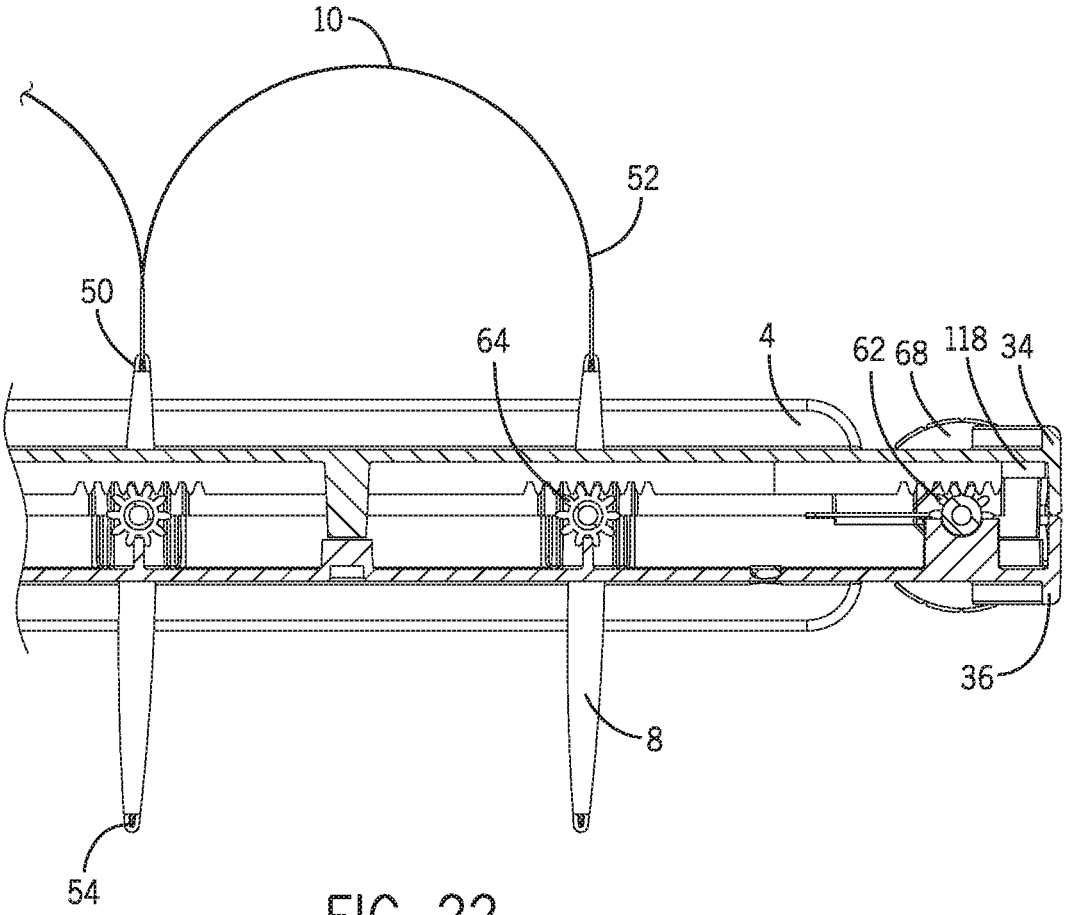
FIG. 22 is an enlarged, fragmentary view of a cross-section of the display tool of FIG. 5 taken along line 22-22 of FIG. 5 in accordance with an embodiment of the present disclosure.

With reference to FIGS. 19-22, a user may actuate the drive assembly 6 to cause the display tool 2 to transition between open and closed positions. To close the display tool 2, the crank member 60 may be rotated in the first rotational direction such as through rotation of the crank handle 68 by a user. As the crank member 60, and the corresponding drive sprocket 62, rotates in the first rotational direction, the first rack member 66A translates within the channel 126 in the first direction (i.e., towards the drive sprocket 62). Translational movement of the first rack member 66A in the first direction rotates each of the plurality of blades 8 in the first rotational direction through meshing engagement of the pinion gear 64 with the rack member 66. Rotation of the crank member 60 in the first rotational direction may continue until the second edge 54 of one of the plurality of blades 8 abuts or is adjacent the first edge 50 of an adjacent blade 8. In some embodiments, actuation of the drive assembly 6 may be restricted by contact of the first edge 50 and/or the second edge 54 of the blade 8 with the soffit members 42. As shown in FIG. 21, in some embodiments, the first rack member 66A may be configured such that a first end 134 of the first rack member 66A contacts the first wall 120 of the first frame 34 to define a first position, such as the closed position.

Opening of the display tool 2, if desired, is accomplished in reverse order as described above. This allows a user to select whether to have the shade material 10 in a fully closed position, a fully open position, or any position in between. To open the display tool 2, a user actuates the drive assembly 6 to cause the crank member 60 to rotate in the second rotational direction. As the crank member 60, and the corresponding drive sprocket 62, rotates in the second rotational direction, the first rack member 66A translates within the channel 126 in the second direction (i.e., away from the drive sprocket 62). Translational movement of the first rack member 66A in the second direction rotates each of the plurality of blades 8 in the second rotational direction to substantially open the display tool 2. In some embodiments, a second end 136 of the first rack member 66A opposite the first end 134 may contact the abutment wall 132 of the first frame 34 to restrict displacement of the first rack member 66A in the second direction and define a second position, such as the open position.

Figure 24:
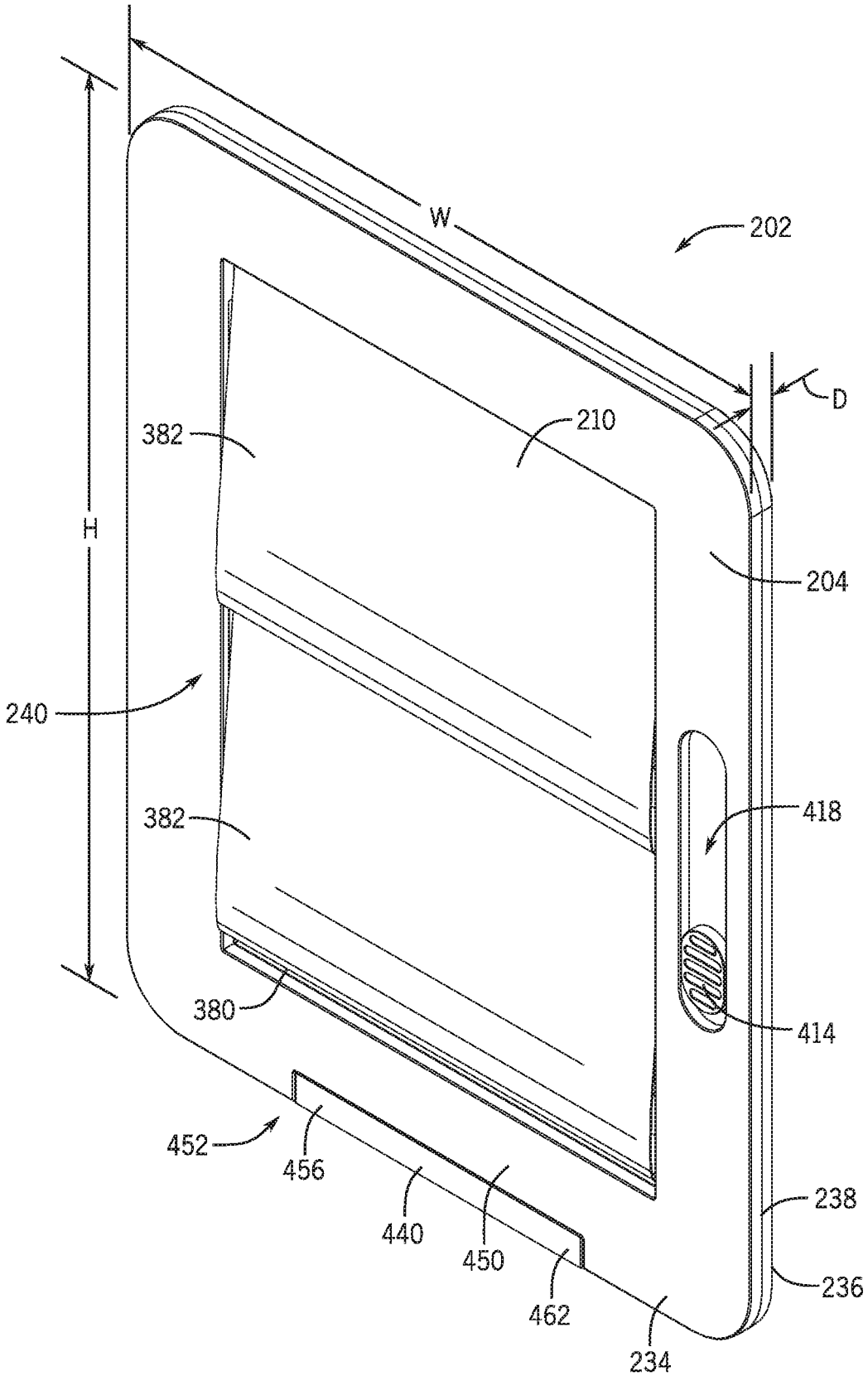
FIG. 24 is a front isometric view of an additional display tool in a closed configuration in accordance with an embodiment of the present disclosure.
Figure 25:
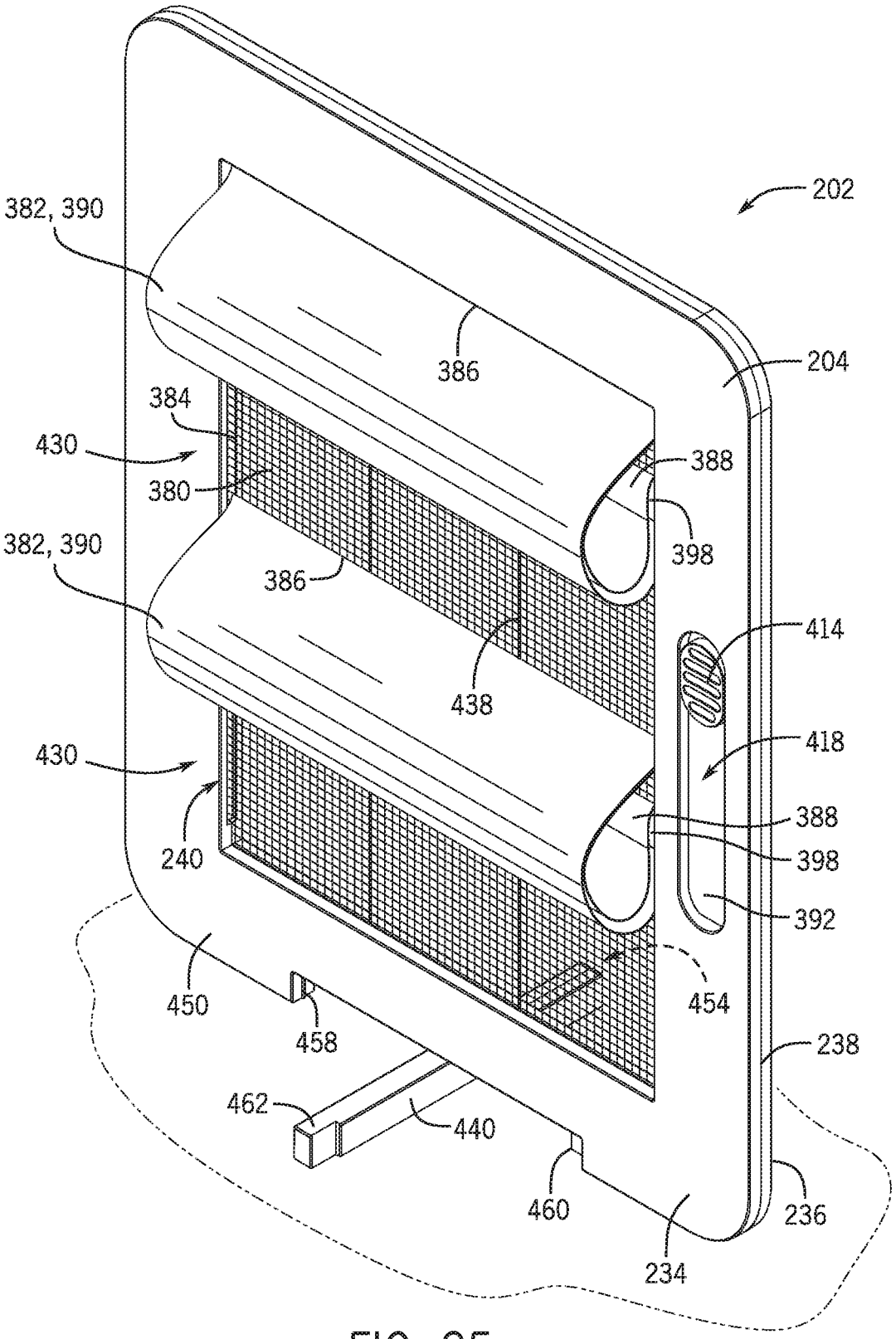
FIG. 25 is a front isometric view of the display tool of FIG. 24 in an open configuration in accordance with an embodiment of the present disclosure.

FIGS. 24-27 illustrate an additional embodiment of a display tool 202 for sampling a scaled-down version of a covering for an architectural opening, such as a shade material 210 (see FIGS. 24 and 25). Like the display tool 2 discussed above, the display tool 202 may be transported to various sites or locations to sample the shade material 210 at the different locales. In general, the display tool 202 is similar to the display tool 2 and its associated description above and thus, in certain instances, descriptions of like features will not be discussed when they would be apparent to those with skill in the art in light of the description above and in view of FIGS. 24-27. For ease of reference, like structure is represented with appropriately incremented reference numbers.

Referring to FIGS. 24 and 25, similar to the display tool 2 discussed above, the display tool 202 may include a portable, cuboid frame structure 204 including first and second frames 234, 236 connected together. As shown, the first and second frames 234, 236 may be connected together at a line of separation 238. In some embodiments, the line of separation 238 may longitudinally bisect the frame structure 204. In some embodiments, one of the first and second frames 234, 236 may be received at least partially within the other of the first and second frames 234, 236 to define the frame structure 204. In such embodiments, the one of the first and second frames 234, 236 may include a thickness dimensioned such that a rear surface of the one of the first and second frames 234, 236 is substantially flush with an outermost portion of the other of the first and second frames 234, 236 when the two frames 234, 236 are connected together. Once connected together, the first and second frames 234, 236 may define the frame structure 204 having a width W and a height H both greater than a depth D (see FIG. 24).

In some embodiments, the frame structure 204 may include dimensions smaller than those of a typical architectural opening such that the display tool 202 may be considered to sample a scaled-down version of an associated covering. For example, both the height H and the width W of the frame structure 204 may be smaller than those of a smallest architectural opening in which the shade material 210 would be placed. The shade material 210 may include the same material (e.g., fabric) as in the corresponding full-sized shade, and the elements of the shade material 210 may operate substantially in the same way. However, the display tool 202 is scaled-down to allow ready transport and display of the shade material 210. In this manner, the display tool 202 may demonstrate to a user or customer the functional (e.g., operation) and/or aesthetic (e.g., general appearance, translucence, texture, etc.) characteristics of the corresponding full-sized shade without installing the full-sized shade within the architectural opening.

Figure 26:
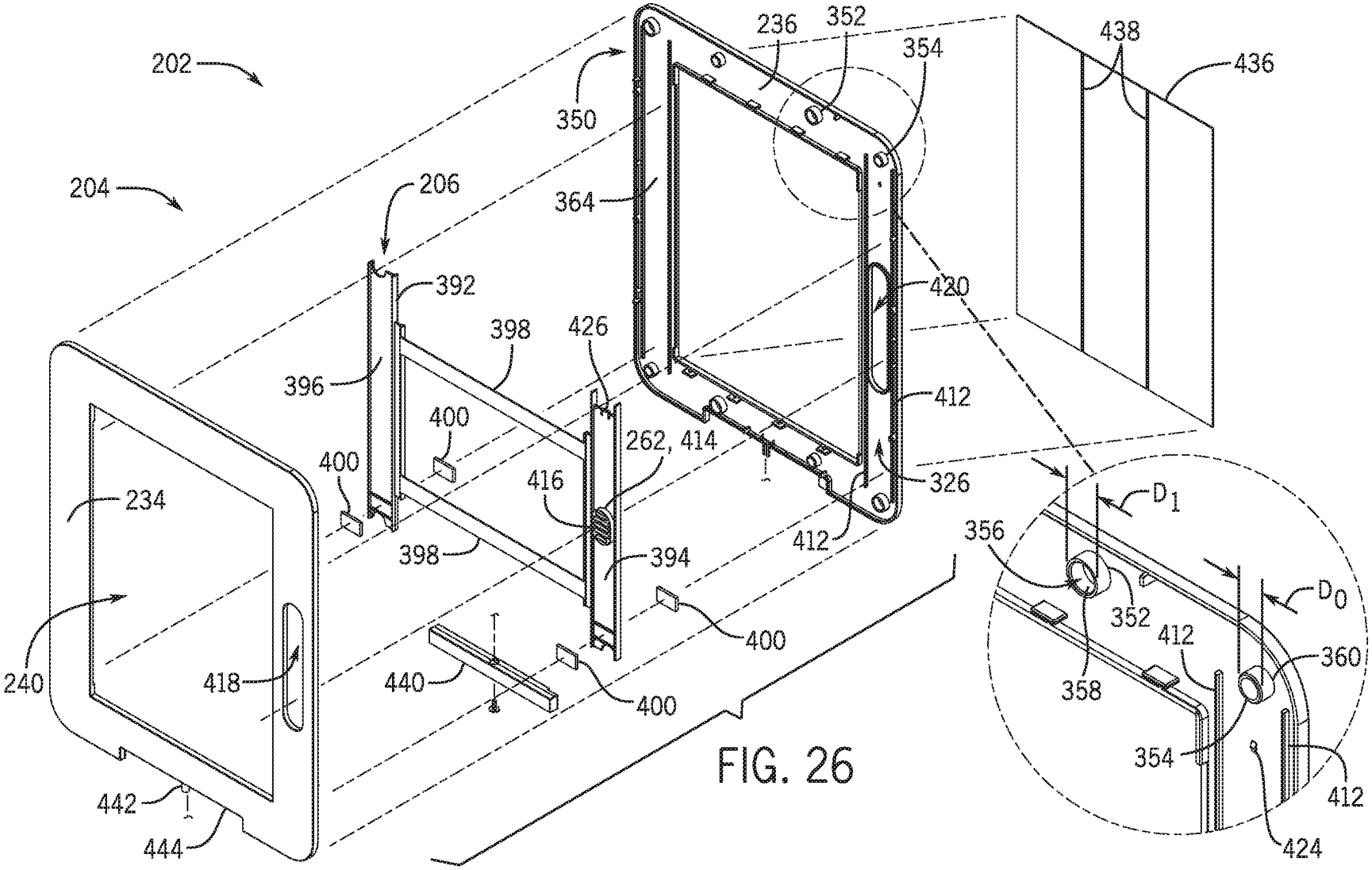
FIG. 26 is an exploded, front view of the display tool of FIG. 24 in accordance with an embodiment of the present disclosure.
Figure 27:
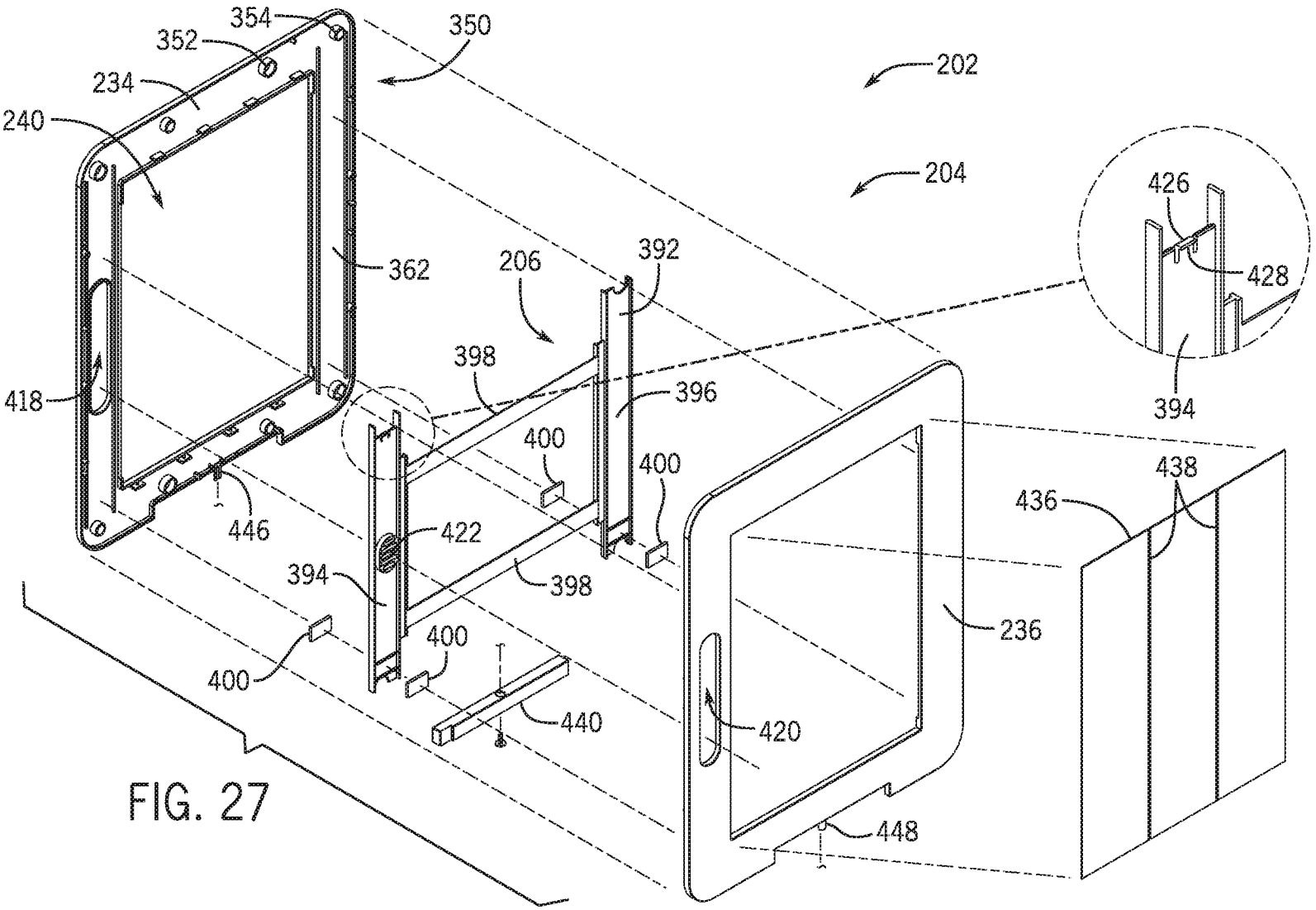
FIG. 27 is an exploded, rear view of the display tool of FIG. 24 in accordance with an embodiment of the present disclosure.

Referring to FIGS. 26 and 27, the first and second frames 234, 236 may be connected together via a plurality of connection mechanisms 350 within the interior of the frame structure 204. In one embodiment, each of the connection mechanisms 350 may include corresponding first and second annular cylinders 352, 354 sized and shaped to engage each other (e.g., through interference fit). For example, as best seen in FIG. 26, the first annular cylinder 352 may include a bore 356 defined by an inner surface 358 of the first annular cylinder 352, the inner surface 358 defining an inner diameter $D_I$ of the first annular cylinder 352. The second annular cylinder 354, which in some embodiments may simply be a right cylinder, may include an outer surface 360 defining an outer diameter $D_O$ of the second annular cylinder 354. The outer diameter $D_O$ of the second annular cylinder 354 may be smaller than the inner diameter $D_I$ of the first annular cylinder 352. In this way, the outer diameter $D_O$ of the second annular cylinder 354 may be dimensioned such that the second annular cylinder 354 may be inserted at least partially within the bore 356 of the first annular cylinder 352. In such embodiments, the first and second annular cylinders 352, 354 may be interference fit with each other such as through frictional engagement between the inner surface 358 of the first annular cylinder 352 and the outer surface 360 of the second annular cylinder 354. The first and second annular cylinders 352, 354 may include corresponding cross-sectional shapes to facilitate the frictional engagement between the inner surface 358 of the first annular cylinder 352 and the outer surface 360 of the second annular cylinder 354. For example, each of the first and second annular cylinders 352, 354 may include a substantially circular cross-section or may include a non-circular cross-section (e.g. rectangular, polygonal, elliptical, etc.). Though shown and described as being connected together via connection mechanisms 350, additionally or alternatively, the first and second frames 234, 236 may be connected together via any suitable connection mechanism, including without limitation mechanical fasteners, adhesive, heat or sonic welding, or the like.

With continued reference to FIGS. 26 and 27, the first and second annular cylinders 352, 354 may be associated with either the first frame 234 or the second frame 236. For instance, as shown in FIG. 27, the first frame 234 may include at least one first annular cylinder 352 and at least one second annular cylinder 354 extending from an inner surface 362 of the first frame 234 towards the second frame 236. Similarly, as shown in FIG. 26, the second frame 236 may include at least one first annular cylinder 352 and at least one second annular cylinder 354 extending from an inner surface 364 of the second frame 236 towards the first frame 234. In such embodiments, the first annular cylinder(s) 352 of the second frame 236 may engage the second annular cylinder (s) 354 of the first frame 234, and the second annular cylinder(s) 354 of the second frame 236 may engage the first annular cylinder(s) 352 of the first frame 234 in the manner described above. Alternatively, in some embodiments, the first frame 234 may include only one type of the first and second annular cylinders 352, 354, with the second frame 236 including the other type of the first and second annular cylinders 352, 354 to secure the first and second frames 234, 236 together.

Referring to FIGS. 24-27, the frame structure 204 may include an interior opening 240 defined in at least the first frame 234 and configured to receive at least a portion of the shade material 210 therein. As illustrated in FIG. 25, the shade material 210 may include a support sheet 380 and a plurality of vanes 382 connected at least partially to a front face 384 of the support sheet 380. Each vane 382 may include first and second edge portions 386, 388 extending along opposing longitudinal edges of the vane 382. The first edge portions 386 may be coupled with the front face 384 of the support sheet 380 such as through adhesive, double-sided tape, stitching, weaving, or other suitable attachment means. The second edge portions 388 may be movable relative to the first edge portions 386 along the front face 384 of the support sheet 380 to open and close the vanes 382. In a closed position, the vanes 382 may extend approximately parallel to the support sheet 380 (see FIG. 24). In an open position, the second edge portion 388 of each vane 382 may move towards the vane's first edge portion 386 to form a curved (e.g., substantially C-shaped) cell 390 in cross-section (see FIG. 25). The support sheet 380, which may be formed from substantially sheer, transparent, and/or translucent fabric, may span the interior opening 240 and may be attached to at least one of the first frame 234 and the second frame 236 adjacent the line of separation 238 such as through adhesive, double-sided tape, fasteners, or other suitable attachment means operable to maintain the support sheet 380 in a substantially taut taught condition across the interior opening 240.

With reference to FIGS. 26 and 27, to move the shade material 210 between open and closed positions, the display tool 202 may include a drive assembly 206. Like the drive assembly 6 discussed above, the drive assembly 206 may move the shade material 210 between open and closed positions by manual movement of an actuation element or mechanism. For example without limitation, the drive assembly 206 may include a panel insert 392 slidably coupled to the frame structure 204. As illustrated, the panel insert 392, which may be substantially rigid, may be positioned at least partially between the first and second frames 234, 236. In one embodiment, the panel insert 392 may include a first rail 394, a second rail 396, and a plurality of rungs 398 extending transversely between the first and second rails 394, 396. When the display tool 202 is in an assembled state, the first and second rails 394, 396 may be positioned between the first and second frames 234, 236. In one embodiment, the first and second rails 394, 396 may slidably engage the inner surfaces 362, 364 of the first and second frames 234, 236, respectively, with the rungs 398 extending across the interior opening 240 of the display tool 202. To facilitate the sliding engagement between the first and second rails 394, 396 and the inner surfaces 362, 364 of the first and second frames 234, 236, the display tool 202 may include a plurality of bushings 400. In one embodiment, the bushings 400 may be positioned between the first and second rails 394, 396 and the inner surfaces 362, 364. As shown in FIGS. 26 and 27, the bushings 400 may be associated with the first and second rails 394, 396 such that the bushings 400 slide against the inner surfaces 362, 364 of the first and second frames 234, 236 as the panel insert 392 moves relative to the frame structure 204. In some embodiments, the bushings 400 may be operable to maintain the relative position between the panel insert 392 and the frame structure 204. For example, though the bushings 400 may facilitate sliding movement of the panel insert 392 relative to the frame structure 204, the bushings 400 may provide sufficient friction to limit relative movement between the panel insert 392 and the frame structure 204 absent an external force provided by a user.

To further facilitate sliding movement of the panel insert 392 relative to the frame structure 204, at least the first rail 394 may be received within a channel 326 defined collectively by a plurality of parallel track members 412 extending from the inner surfaces 362, 364 of the first and second frames 234, 236. The size and shape of the channel 326 may correspond with the size and shape of the first rail 394 such that the channel 326 defines a substantially linear path along which the first rail 394 moves. In such embodiments, the channel 326 may be operable to limit rotational movement of the panel insert 392 relative to the frame structure 204. With reference to FIG. 26, an actuation element 262, such as slider 414, may be mounted on a side of the frame structure 204. For example, the actuation element 262 may be positioned on the first rail 394 of the panel insert 392 to permit a user to slide the panel insert 392 within the frame structure 204 to move the shade material 210 between open and closed positions, as more detailed below. In some embodiments, the actuation element 262 (e.g., the slider 414) may be configured for engagement by a user's hand. As illustrated, the slider 414 may include an outer surface 416 operable to provide sufficient grip for a user's fingers. In such embodiments, at least the first frame 234 may include a slider opening 418 permitting user access to the slider 414 once the display tool 202 is assembled. Though the slider opening 418 is described with reference to the first frame 234, additionally or alternatively, the second frame 236 may include a second slider opening 420 to receive a second slider 422 positioned on the first rail 394 opposite the slider 414 (see FIG. 27). Though the display tool 202 is shown and described with reference to a slider 414, it is contemplated that the panel insert 392 may be operated by a thumb wheel similar to the crank handle 68 discussed above. In like manner, it is contemplated that the display tool 2 discussed above may be operated by a slider mechanism similar to the slider 414 discussed herein.

With reference to FIG. 25, each second edge portion 388 of the shade material 210 may be attached to a respective rung 398 of the panel insert 392. For example, each second edge portion 388 may be attached to its respective rung 398 via adhesive, double-sided tape, fasteners, or other suitable attachment means. In such embodiments, movement of the panel insert 392 relative to the frame structure 204 moves the second edge portions 388 relative to the first edge portions 386 to open and close the shade material 210. With reference to FIGS. 24 and 25, the slider opening 418 may be sized and shaped to permit the panel insert 392 to slide between a fully closed shade position and a fully open shade position. In the fully closed shade position (see FIG. 24), the slider 414 may contact a portion of the first frame 234 defining one end (e.g., a bottom end) of the slider opening 418. In the fully open shade position (see FIG. 25), the slider 414 may contact another portion of the first frame 234 defining the opposite end (e.g., an upper end) of the slider opening 418. With reference to FIGS. 26 and 27, in some embodiments, the display tool 202 may include structure operable to releasably maintain the panel insert 392 in the fully open shade position. For instance, referring to FIG. 26, the second frame 236 may include a tab 424 extending from its inner surface 364 towards the first frame 234. In such embodiments, the first rail 394 may include a resilient arm 426 engageable with the tab 424 to releasably secure the panel insert 392 in position. For instance, referring to FIG. 27, the resilient arm 426 in one embodiment may include a protrusion 428 engageable with the tab 424 to limit transverse movement of the arm 426 relative to the tab 424 after engagement.

With reference to FIGS. 24 and 25, a user may actuate the slider 414 to cause the display tool 202 to transition between a closed configuration (see FIG. 24) and an open configuration (see FIG. 25). To open the display tool 202, the slider 414 may be slid within the slider opening 418 in a first direction (e.g., upwards in FIG. 24). As the slider 414 moves within the slider opening 418 in the first direction, the rungs 398 of the panel insert 392 translate in the first direction to cause the second edge portion 388 of each vane 382 to move along the support sheet 380 towards a respective first edge portion 386 to permit light and/or vision to pass through the shade material 210. In such embodiments, a gap 430 may be defined between adjacent cells 390 and/or between a cell 390 and a portion of the display tool 202 (see FIG. 25). Translation of the slider 414 within the slider opening 418 in the first direction may continue until, for example, the slider 414 contacts a portion of the first frame 234 defining an upper extent of the slider opening 418. Once in this position, the shade material 210 may be releasably held open by the engagement between the arm 426 of the panel insert 392 and the tab 424 of the second frame 236.

Closing the display tool 202, if desired, may be accomplished in substantially reverse order as described above, thus allowing a user to select whether to have the shade material 210 in a fully closed position, a fully open position, or any position in between. To close the display tool 202, the slider 414 may be slid within the slider opening 418 in a second direction (e.g., downwards in FIG. 24) opposite the first direction. As the slider 414 moves within the slider opening 418 in the second direction, the rungs 398 of the panel insert 392 may translate in the second direction to cause the first and second edge portions 386, 388 of each vane 382 to move away from each other, thereby decreasing the size of the gap 430 to limit the ability of light and/or vision to pass through the shade material 210. Translation of the slider 414 within the slider opening 418 in the second direction may continue until the slider 414 contacts a portion of the first frame 234 defining a lower extent of the slider opening 418. When the display tool 202 is fully closed, the shade material 210 in one embodiment may be positioned substantially entirely within the interior opening 240 (see FIG. 24).

In some embodiments, operation of the actuation element or mechanism (i.e., the slider 414, the panel insert 392, the blades 8, the crank handle 68, etc.) may be operationally different from that of a corresponding full-scale shade of which the display tool 2 or 202 is modeling or sampling. For example, the display tool 2 or 202 may utilize rigid operation elements (e.g., the panel insert 392, the blades 8, the crank handle 68, etc.) to move the shade material 10 or 210, respectively, between open and closed positions, the rigid operation elements being different than the flexible operation elements found in the corresponding full-scale shade. For example, the full-scale shade that is represented by the shade material 210 of the display tool 202 may be operated by rollers rotatably received within a head rail, such as the operating mechanism disclosed in U.S. Pat. No. 8,496,768, rather than the frame and slide mechanism discussed above. Similarly, the full-scale shade which is represented by the shade material 10 of the display tool 2 may be operated by a linkage mechanism, such as the operating mechanism disclosed in U.S. Pat. No. 5,819,833, rather than the rack and pinion mechanism discussed above. Though the shade material 10 or 210 may be actuated differently than the full-sized shade, the resulting operation/movement of the shade material 10 or 210 is substantially the same so a user or customer may be able to appreciate the aesthetics, the functionality, and/or the different configurations of the shade.

Despite the display tools 2, 202 not having the same operating/actuating mechanisms as in the full-scale shade, the display tools 2, 202 may include features that make the display tools 2, 202 as realistic as possible. For example, with reference to FIGS. 26 and 27, the display tool 202 may include a pane 436 connected to (e.g., integrally formed with, coupled to, etc.) the second frame 236. The pane 436, which may be transparent or translucent, may provide rigidity to the frame structure 204 and/or the shade material 210. For example, the pane 436 may abut a rear portion of the support sheet 380 to provide support to the shade material 210 during operation and/or storage. As illustrated, the pane 436 may include a plurality of vertical, spaced-apart lines 438. In such embodiments, the lines 438 may mimic the appearance of control cords, such as the operating elements disclosed in U.S. Pat. No. 8,496,768, of the full-scale shade so the display tool 202 accurately models the full-scale shade as closely as possible.

Referring to FIGS. 24 and 25, the display tool 202 may include other features for convenience. For example, the display tool 202 may include a stand 440 integrated with the frame structure 204 (e.g., with the first and second frames 234, 236). As illustrated in FIG. 26, the stand 440 may be an elongate member rotatably coupled to a post 442 extending from a bottom end wall 444 of the frame structure 204. In some embodiments, the post 442 may be defined collectively by post halves 446, 448 extending from the first and second frames 234, 236, respectively (see FIG. 27). The stand 440 may rotate about the post 442 relative to the frame structure 204 to extend the stand 440 at an angle relative to a front surface 450 of the first frame 234 (see FIG. 25). When sufficiently rotated, the stand 440 may permit the display tool 202 to stand upright on a support surface. In some embodiments, the stand 440 may be releasably secured in a closed position, such as via a detent structure 452. For example, the stand 440 may define a groove 454 therein (e.g., on a first end 456 of the stand 440). In such embodiments, a tab 458 may extend from the frame structure 204 (e.g., from the bottom end wall 444) for corresponding receipt within the groove 454 of the stand 440 to releasably secure the stand 440 in a closed position. Additionally or alternatively, the frame structure 204 may define a limit wall 460 extending within the rotational path of the stand 440. In such embodiments, the limit wall 460 may engage a second end 462 of the stand 440 opposite the first end 456. In this manner, the limit wall 460 may prevent full rotation of the stand 440 and may further define the closed position of the stand 440. In some embodiments, the limit wall 460 and the second end 462 of the stand 440 may be correspondingly shaped such that the stand 440 lies substantially flush with at least the front surface 450 of the first frame 234 when the stand is in the closed position (see FIG. 24).

Figure 23:
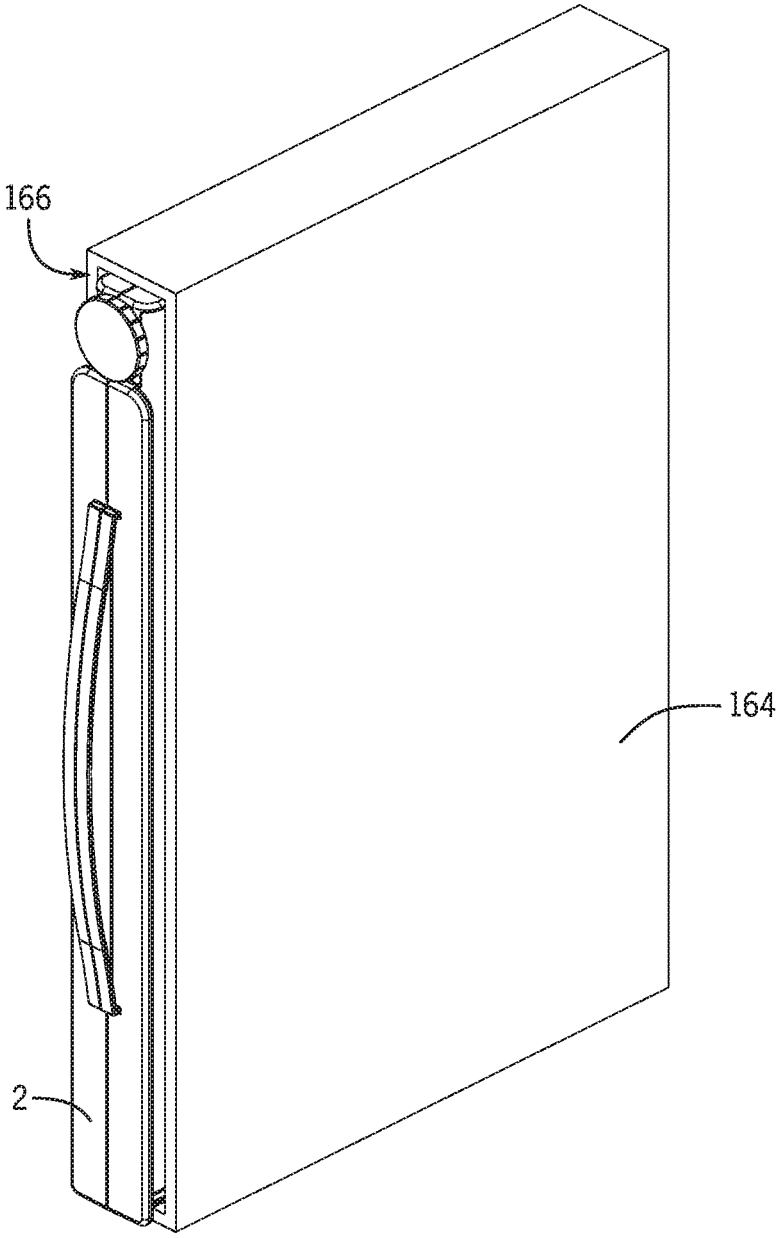
FIG. 23 is an isometric view of the display tool of FIG. 1 inserted within a storage container in accordance with an embodiment of the present disclosure.

With reference to FIG. 23, in some embodiments, the display tool 2 or 202 may be releasably stored within a storage container 164 to protect the display tool 2 or 202 from damage, for example. The storage container 164 may include a chamber 166 having internal dimensions sufficient to receive the display tool 2 or 202 therein. In such embodiments, the display tool 2 or 202 may be releasably secured within the storage container 164. For example without limitation, the display tool 2 may include at least one magnet secured within the frame structure 4 proximate an end face of the frame structure 4. For example, with reference to FIGS. 15, 15D, and 16-17, the frame structure 4 may include a receiving slot 138 defined inwardly from a second sidewall 140 of the frame structure 4 opposite the first sidewall 32 and configured to receive a first magnet. A second magnet may be positioned along an interior wall of the chamber 166 such that receipt of the display tool 2 within the chamber 166 aligns the first magnet with the second magnet to releasably secure the display tool 2 within the chamber 166 of the storage container 164. Additionally or alternatively, in some embodiments, the display tool 2 or 202 may be releasably secured within the chamber 166 of the storage container 164 through other securement means, including corresponding retention features, hook and loop fasteners, or any other suitable securing means.

The display tool 2 or 202, including for example without limitation the frame structure 4 or 204, the first frames 34 or 234, the second frames 36 or 236, the panel insert 392, the stand 440, the soffit members 42, the blades 8, and each component of the drive assembly 6 or 206 may be constructed of substantially any type of material. For example, the frame structure 4 or 204, the soffit members 42, the blades 8, and the drive assembly 6 may be constructed from natural and/or synthetic materials, including metals, ceramics, plastics, and/or other suitable materials. Plastic materials may include thermoplastic material (self-reinforced or fiber-reinforced), ABS, polycarbonate, polypropylene, polystyrene, PVC, polyamide, or PTFE, among others. The frame structure 4 or 204, the soffit members 42, the blades 8, and the drive assembly 6 may be built, formed, molded, or non-molded in any suitable manner, such as by plug molding, blow molding, injection molding, milling, or the like. In some embodiments, the second frame 236 may be at least partially transparent or translucent to permit light to pass therethrough to accurately simulate light impinging on the shade material 210.

The foregoing description has broad application. While the provided examples describe a display tool sampling a shade marketed under the Pirouette® brand, it should be appreciated that the concepts disclosed herein may equally apply to many types of shades, including Venetian blinds and stackable shades or coverings. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation.

The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A display tool comprising:

a portable frame structure;

a drive assembly coupled to and received at least partially within said frame structure, said drive assembly including an actuation element at least partially mounted within and supported by said frame structure, said actuation element accessible through an opening formed in said frame structure; and a shade material connected at least partially to said drive assembly, said shade material including a support sheet and a plurality of vanes connected to a front face of said support sheet, said plurality of vanes including first and second edge portions, said shade material enclosed by said frame structure, said support sheet being fixedly coupled to said frame structure across an interior opening of said frame structure so that said support sheet always remains in an extended configuration, wherein said drive assembly is arranged and configured to move said second edge portion of said vanes toward said first edge portion of said vanes, said support sheet being coupled to said frame structure so that said support sheet remains stationary in said extended configuration across said interior opening of said frame structure unaffected by movement of said vanes.

2. The display tool of claim 1, wherein said drive assembly is substantially rigid.

3. The display tool of claim 1, wherein said drive assembly is arranged and configured to move said second edge portion of said vanes toward said first edge portion of said vanes via translation of a substantially rigid structure.

4. The display tool of claim 1, wherein said second edge portion of said vanes is configured to be moved toward said first edge portion of said vanes by manual movement of said actuation element of said drive assembly.

5. The display tool of claim 1, wherein said actuation element is mounted on a side of said frame structure.

6. The display tool of claim 1, wherein said actuation element is a slider slidably coupled with said frame structure.

7. The display tool of claim 6, wherein said opening is a slider opening defined within said frame structure for receiving said slider.

8. The display tool of claim 1, wherein said second edge portion of said vanes is configured to be moved toward said first edge portion of said vanes by a plurality of rigid operation elements.

9. The display tool of claim 1, wherein:

said drive assembly includes a panel insert comprising:

first and second rails slidably received within said frame structure; and a plurality of rungs extending transversely between said first and second rails;

said actuation element is a slider positioned on said first rail for manual manipulation of said panel insert;

said shade material is connected to said plurality of rungs; and said slider is arranged and configured to displace said panel insert to move said second edge portion of said vanes toward said first edge portion of said vanes.

10. The display tool of claim 9, wherein said panel insert is substantially rigid.

11. The display tool of claim 1, wherein said frame structure comprises a first frame and a second frame.

12. The display tool of claim 11, wherein a portion of said drive assembly is slidably supported substantially between said first frame and said second frame.

13. The display tool of claim 1, wherein said shade material is arranged and configured to form a curved cell when said second edge portion of said vanes is brought towards said first edge portion of said vanes.

14. The display tool of claim 1, wherein said support sheet abuts a transparent or translucent pane, said pane including a plurality of vertical, spaced-apart lines.

15. A display tool comprising:

a frame structure;

a slider coupled to and received at least partially within said frame structure, said slider being accessible through a first opening formed in said frame structure; and a shade material positioned within a second opening formed in said frame structure and connected at least partially to said slider, said shade material including a support sheet and a plurality of vanes connected to a front face of said support sheet, said plurality of vanes including first and second edge portions;

wherein:

said support sheet being fixedly coupled to said frame structure across the second opening of said frame structure so that said support sheet always remains in an extended configuration; and said slider is arranged and configured to move said second edge portion of said vanes towards said first edge portion of said vanes without moving said support sheet so that said support sheet remains extended across said second opening formed in said frame structure.

16. The display tool of claim 15, wherein said second edge portion of said vanes is configured to be moved towards said first edge portion of said vanes by manual movement of said slider.

17. The display tool of claim 15, further comprising a panel insert comprising:

first and second rails slidably received within said frame structure; and a plurality of rungs extending transversely between said first and second rails;

wherein:

said slider is positioned on said first rail for manual manipulation of said panel insert;

said shade material is connected to said plurality of rungs; and said slider is arranged and configured to displace said panel insert to move second edge portion of said vanes towards said first edge portion of said vanes.

18. The display tool of claim 15, wherein:

said frame structure comprises a first frame and a second frame; and a portion of said slider is slidably supported substantially between said first frame and said second frame.

* * * * *